US005822732A

United States Patent [19]

Tasaki

[11] Patent Number: 5,822,732

[45] Date of Patent: Oct. 13, 1998

[54] FILTER FOR SPEECH MODIFICATION OR ENHANCEMENT, AND VARIOUS APPARATUS, SYSTEMS AND METHOD USING SAME

[75] Inventor: Hirohisa Tasaki, Kamakura, Japan

[73] Assignee: Mitsubishi Denki Kabushiki Kaisha, Tokyo, Japan

[21] Appl. No.: 643,087

[22] Filed: May 2, 1996

[30] Foreign Application Priority Data

May 12, 1995 [JP] Japan ..... 7-114752

[51] Int. Cl.[6] ..... G10L 9/08

[52] U.S. Cl. ..... 704/268; 704/209; 704/217

[58] Field of Search ..... 395/2.77, 2.71, 395/2.28, 2.75, 2.09, 2.12, 2.32, 2.23, 2.24, 2.25, 2.18; 704/268, 262, 219, 266, 200, 203, 223, 214, 215, 216, 209, 217, 263

[56] References Cited

U.S. PATENT DOCUMENTS

| | | | |
|---|---|---|---|
| 4,393,272 | 7/1983 | Itakura et al. | 395/2.75 |
| 5,187,745 | 2/1993 | Yip et al. | 395/2.28 |
| 5,226,083 | 7/1993 | Taguchi | 395/2.14 |
| 5,241,650 | 8/1993 | Gerson et al. | 395/2.09 |
| 5,307,441 | 4/1994 | Tzeng | 395/2.31 |
| 5,579,437 | 11/1996 | Fette et al. | 395/2.71 |
| 5,596,677 | 1/1997 | Jarvinen et al. | 395/2.39 |

FOREIGN PATENT DOCUMENTS

| | | | |
|---|---|---|---|
| 64-13200 | 1/1989 | Japan | G10L 9/10 |
| 2-82710 | 3/1990 | Japan | H03H 17/02 |
| 5-500573 | 2/1993 | Japan | G10L 9/14 |

OTHER PUBLICATIONS

Kazuhito Koishida, Keiichi Tokuda, Takao Kobayashi & Satoshi Imai "Speech Coding System Based on Adaptive Mel–Cepstral Analysis for Noisy Channel" Tokyo Institute of Technology pp. 257–258.

*Primary Examiner*—Allen R. MacDonald
*Assistant Examiner*—Richemond Dorvil
*Attorney, Agent, or Firm*—Wolf, Greenfield & Sacks, P.C.

[57] ABSTRACT

A speech modification or enhancement filter, and apparatus, system and method using the same. Synthesized speech signals are filtered to generate modified synthesized speech signals. From spectral information represented as a multi-dimensional vector, a filter coefficient is determined so as to ensure that formant characteristics of the modified synthesized speech signals are enhanced in comparison with those of the synthesized speech signal and in accordance with the spectral information. The spectral information can be any one of LSP information, PARCOR information and LAR information. A degree of freedom of design of the speech modification filter used for the aural suppression of quantizing noise contained in the synthesized speech signals is thus heightened leading to the improvement of intelligibility of said synthesized speech signals. A good formant enhancement effect can be obtained without allowing any perceptible level of distortions to occur within a range of permissible spectral gradients.

29 Claims, 20 Drawing Sheets

FILTER FOR SPEECH MODIFICATION OR ENHANCEMENT, AND VARIOUS APPARATUS, SYSTEMS AND METHOD USING SAME

BACKGROUND OF THE INVENTION a) Field of the Invention

The present invention relates generally to a system and a method for transmitting or storing speech information by means of codes having a lower information content than that of input speech signals. This invention relates in particular to a system and a method for extracting from the input speech signals parameters indicative of their characteristics, transmitting or storing the extracted parameters, and synthesizing the original speech signals on the basis of the transmitted or stored parameters. More specifically, the invention is directed to an speech modification filter for aurally suppressing quantizing noise occurring in the synthesized speech signals. Further, the present invention relates to a system, a method and a filter for enhancing the quality of the signal such as a speech intelligibility. More specifically, the present invention relates to a speech enhancement which is suitable for improving the speech intelligibility of the signal having distortions caused by analog transmission or the signal received by the hard-of-hearing aid apparatus and which is suitable for improving the brightness of the speech to be broadcasted or to be output by a loud-speaker.

b) Description of the Related Art

A configuration of a speech analysis/synthesis system is illustrated by way of example in FIG. 28. The system in this diagram comprises an analyzing unit 100 and a synthesizing unit 200. The analyzing unit 100 includes an analyzer 101 and a coder 102, whilst the synthesizing unit 200 includes a decoder 201 and synthesizer 202. In some applications the units 100 and 200 are linked to each other through communication channels, one unit typically being remote from the other. In other applications the unit 100 transmits information through storage media to the unit 200, wherein the two units may constitute a single apparatus or two separate apparatus. The analyzer 101 extracts, from input speech signals supplied from a user, parameter group which includes spectral information indicative of characteristics of the input speech signals. The extracted parameter group is coded by the coder 102 and is fed through the communication channels or the storage media to the synthesizing unit 200 in which the coded parameter group is decoded by the decoder 201. The synthesizer 202 serves to synthesize speech signals on the basis of the thus decoded parameter group. One advantage of the system having such a configuration lies in the lower information content of the transmitted or stored signals. This is attributable to the fact that the transmitted or stored signals, that is, the coded parameter group contain a lower information content compared with the input speech signals.

A variant of the synthesizing unit 200 is illustrated in FIG. 29. This variant further comprises a post filter 203 serving to subject speech signals derived from the synthesizer 202 (hereinafter referred to as synthesized speech signals) to a predetermined modification process, on the basis of the decoded parameter group, thereby generating modified speech signals (hereinafter referred to as modified synthesized speech signals). The post filter 203 is used in some applications to aurally suppress the quantizing noise contained in the synthesized speech signals, but in other applications it is used to improve subjective quality such as speech intelligibility. In the following description the post filter of this type will be referred to as a speech modification filter or a speech enhancement filter. The synthesizing unit 200 provided with such a filter 203 is suited for use in a voice coding/decoding system or a voice recognition and response system.

A variety of filters are available as the filter 203. Above all, a filter of a type enhancing formant characteristics has the advantage of being significantly effective in suppression of the quantizing noise and in improvement of the subjective quality. Prior art references disclosing such a filter include for example:

- Japanese Patent Laid-open Pub. No. Sho64-13200 (hereinafter referred to as reference 1);
- Japanese Patent Laid-open Pub. No. Hei5-500573 (hereinafter referred to as reference 2);
- Japanese Patent Laid-open Pub. No. Hei2-82710 (hereinafter referred to as reference 3); and
- "Speech Coding System Based on Adaptive Mel-Cepstral Analysis for Noisy Channel" Proceeding of Spring Meeting of Acoustical Society of Japan, Vol. 1, pp. 257–258 (1994. 3) (hereinafter referred to as reference 4).

Filters set forth in the references 1 and 2 are both used as the speech modification filter 203 in the synthesizing unit 200 which receives codes of linear prediction coefficients (LPCs) as the above-described coded parameter group from the analyzing unit 100. A filter set forth in the reference 3 is used as the speech modification filter 203 in the synthesizing unit 200 which receives autocorrelation coefficients as the above-described coded parameter group from the analyzing unit 100. Finally a filter set forth in the reference 4 is used as the speech modification filter 203 in the synthesizing unit 200 which receives mel-scaled cepstrum or mel-cepstrum as the above-described parameter group from the analyzing unit 100.

FIG. 29 illustrates a schematic configuration of the filter disclosed in the reference 1. This filter 203 receives decoded LPCs from the decoder 201 in addition to the synthesized speech signals fed from the synthesizer 202. The LPCs referred to herein mean $\alpha$ parameters obtained by linear prediction coding to be executed by the analyzer 101 depicted in FIG. 28. The linear prediction coding is a method for determining, on the basis of sampled values of input speech signal waveforms and in accordance with the linear prediction method, $\alpha$ parameters or filter coefficients of filters of, e.g., orders eight to twelve modeling a human vocal mechanism.

The filter 203 shown in FIG. 30 includes a filter 204 for filtering synthesized speech signals to generate semi-modified synthesized speech signals, and a filter 205 for filtering the semi-modified synthesized speech signals to generate modified synthesized speech signals, the filters 204 and 205 both using $\alpha$ parameters as their filter coefficients. It is to be noted that the $\alpha$ parameter used in the filter 204 is not $\alpha$ parameter $\alpha_i$ (where i=1, 2, . . . , p; p being a prediction order) fed from the decoder 201, but $\alpha 1_i=\alpha_i/\nu^{-i}$ obtained by modifying the $\alpha$ parameter $\alpha_i$ with a modified coefficient $\nu$. In the same manner the $\alpha$ parameter for use in the filter 205 is $\alpha 2_i=\alpha_i/\eta^{-i}$ obtained by modifying the $\alpha$ parameter $\alpha_i$ with a modified coefficient $\eta$. The process for modifying the $\alpha$ parameter $\alpha_i$ with the modified coefficients $\nu$ and $\eta$ is executed by LPC modification sections 206 and 207, respectively.

Now assume that the filters 204 and 205 implement a denominator and a numerator, respectively, of a transfer function H(z) for transforming the synthesized speech signals into the modified synthesized speech signals. In other words, let the filters 204 and 205 be an LPC filter and an inverse-LPC filter, respectively. Furthermore, filtering using the $\alpha$ parameter $\alpha_i$ as the filter coefficients is assumedly given as:

$$A(z) = \sum_{i=0}^{p} (\alpha_i z^{-i}) \tag{1}$$

where z is a z transformation operator. Since the filter coefficients used in the filters 204 and 205 are respectively $\alpha 1_i = \alpha_i / \nu^{-i}$ and $\alpha 2_i = \alpha_i / \eta^{-i}$ as described above, the transfer functions of the filters 204 and 205 are respectively represented in the form of 1/A (z/ν) and A(z/η). Therefore the transfer function for transforming the synthesized speech signals into modified synthesized speech signals can be expressed as:

$$H(z) = A(z/\eta)/A(z/\nu) \tag{2}$$

FIG. 31 schematically illustrates a configuration of the filter disclosed in the reference 2. In this filter 203, $\alpha 1_i$ generated in the LPC modification section 206 is transformed by an LPC/ACC transform section 208 from an LPC domain into an autocorrelation domain, and is subjected to a bandwidth expansion within the autocorrelation domain by an ACC modification section 209, and in accordance with Levinson recursion, is transformed by an ACC/LPC transform section 210 from the autocorrelation domain into the LPC domain. The filter 205 receives $\alpha 2_i$ obtained in this manner. Although the LPC modification section 207 shown in FIG. 30 is removed in this diagram, the reference 2 also suggests a configuration including the LPC modification section 207 whose output $\alpha 2_i$ is again modified by the LPC/ACC transform section 208, ACC modification section 209 and ACC/LPC transform section 210.

FIG. 32 illustrates a schematic configuration of a filter disclosed in the reference 3. This filter 203 is so configured as to have ACC/LPC transform sections 211 and 212 in addition to the configuration of the reference 1. The ACC/LPC transform section 211 receives autocorrelation constants as spectral information included in decoded parameter group and then transforms the received autocorrelation constants from the autocorrelation domain into the LPC domain. The ACC/LPC transform section 212 receives a part of order m (m<p) or less of the autocorrelation constants to be received by the ACC/LPC transform section 211 and then transforms the received autocorrelation constants from the autocorrelation domain into the LPC domain. The LPC modification sections 206 and 207 modify $\alpha$ parameters derived from the ACC/LPC transform sections 211 and 212, respectively, in the same manner as the reference 1. It is to be appreciated that the autocorrelation constants to be provided as input in this configuration may be ones which have been decoded by the decoder 201 (that is, autocorrelation constants obtained through calculation by the analyzer 101 and through coding by the coder 102), or may be ones which have been calculated by the decoder 201 or synthesizer 202 on the basis of different type of spectral parameters decoded in the decoder 201.

FIGS. 33 to 35 represent log-power vs. frequency spectrum characteristics of the speech modification (or enhancement) filters disclosed in the references 1 to 3. In these diagrams, A to D represent, respectively, characteristics of the synthesizer 202, characteristics of the filter 204, inverse characteristics of the filter 205, and the transfer function H (z). For example, in FIGS. 30 and 33, A represents 1/A (z); B represents 1/A (z/ν); C represents 1/A (z/η); and D represents H (z)=A (z/η)/A (z/ν). As is apparent from the expression (2) relating to reference 1 and also from FIGS. 33 to 35 relating to references 1 to 3, the filter 204 functions as a filter enhancing formants of spectrum of the synthesized speech signals and suppressing valleys of that spectrum, whilst the filter 205 functions as a filter eliminating a spectral gradient induced by the filter 204. It is envisaged that the degree of enhancement and suppression by the filter 204 will increase accordingly as ν becomes larger, and that it will decrease as ν becomes smaller. It is assumed in the reference 1 that η and ν satisfy $0 \leqq \eta \leqq \nu < 1$. FIG. 33 represents an example with ν=0.8, η=0.5; FIG. 34 an example using a bandwidth expansion process through a 1200 Hz lag window with ν=0.8; and FIG. 35 an example with p=10, m=4, ν=0.95, η=0.95.

As is clear from the comparison between FIGS. 33 and 34 or from the comparison between FIGS. 33 and 35, the speech modification (or enhancement) filter in the references 2 and 3 will be able to heighten the effect of eliminating the spectral gradient using the filter 205 compared with the filter disclosed in the reference 1. That is, the technique disclosed in the reference 1 will not allow the filter 205 to fully cancel the spectral gradient conferred by the filter 204. Furthermore since the spectral gradient varies with the passage of time, it would be difficult for a fixed high-frequency spectrum enhancement process to cancel the spectral gradient, which will result in a variation of brightness with time. On the contrary, the techniques disclosed in the references 2 and 3 will make it possible to heighten the effect of enhancing the peak-valley structure of the spectrum and to render the spectral gradient flatter. This will lead to a prevention of deterioration in brightness and naturalness by the filter 203.

It is to be appreciated that the techniques disclosed in the references 2 and 3 are in one aspect an improvement over the technique disclosed in the reference 1, but in another aspect are inferior to that. For example, although it may depend on the configuration of the analyzing unit 100 or on the mode to which the system conforms, the technique disclosed in the reference 2 has a deficiency that the resultant modified synthesized speech signals often involve unique distortions. This arises from the fact that an extremely powerful spectrum smoothing process is performed within the autocorrelation domain with the result that the spectrum is remarkably distorted in the vicinity of the strong formants. This may result in the modified synthesized speech signals which are inferior in quality to the technique disclosed in the reference 1. In the case of the technique disclosed in the reference 3, due to a reduction in the filter order in the autocorrelation domain, it often suffers from inconveniences that the positions of the formants are displaced to a great extent or that a plurality of formants become integrated into one. Such an unstable spectral variation will give rise to distortions in the modified synthesized speech signals. From a comparison between the characteristics B and C indicated in FIG. 35, for example, it can be seen that a phenomenon occurs in which formant having the lowest frequency among the formants in B moves to a lower frequency in C and a phenomenon of integration of two formants in the middle. Moreover the significant formant displacement due to such causes may occur or may not occur with time, with the result that the resultant modified synthesized speech will fluctuate unnaturally.

The techniques disclosed in the references 1 to 3 also entail a common problem of a low degree of freedom of design (freedom in operation and control of characteristics). In the case of the technique disclosed in the reference 1 for example, it would be difficult to change the characteristics of the filter 203 to a large extent merely by varying ν and η within a range in which the problems of the spectral gradient and its variation with time do not become so marked. In the case of the technique disclosed in the reference 2, if larger variable ranges are set for ν and lag window frequency to heighten the formant enhancement effect of the filter 204, then the above-described distortions, that is, the distortions attributable to the spectrum smoothing process within the autocorrelation domain will become more significant. Therefore the variable ranges of ν and lag window frequency must be restricted, making it impossible to greatly change the characteristics of the filter 203. In the case of the technique disclosed in the reference 3, the freedom of characteristics will be naturally lowered since it employs the filter order as its control variable, which is a finite integral value.

FIG. 36 schematically illustrates a configuration of the speech modification (or enhancement) filter 203 disclosed in the reference 4. The filter 203 in this diagram differs greatly from the above-described prior art techniques in that it receives mel-scaled cepstrum as spectral information included in decoded parameter group from the decoder 201 and that it transforms synthesized speech signals into modified synthesized speech signals through filtering, using as its filter coefficient modified mel-scaled cepstrum obtained by modifying input mel-scaled cepstrum. That is, synthesized speech signals are filtered by a filter 213 using as its filter coefficients modified mel-scaled cepstrum generated by a mel-scaled cepstrum modification section 214. More specifically, the mel-scaled cepstrum modification section 214 replaces the first-order component of the input mel-scaled cepstrum with 0 and multiplies the other components by β to thereby generate modified mel-scaled cepstrum. The filter 213 makes use of this modified mel-scaled cepstrum as its filter coefficient to filter the synthesized speech signals, and provides obtained signals as its output in the form of modified synthesized speech signals. Incidentally, the filter 213 is referred to as a mel-scaled log-spectral approximation (MLSA) filter since it employs the modified mel-scaled cepstrum as its filter coefficient.

The term mel-scaled cepstrum used herein means a parameter calculated by the analyzer 101 through orthogonal transformation of the log spectrum of input speech signals. It would generally be impossible for the techniques of the references 1 to 3 to be applied as it stands to a system in which the speech information is transformed into mel-scaled cepstrum for transmission or storage. That is, transformation of cepstrum parameters such as mel-scaled cepstrum into the LPC domain would cause a significant distortion of spectral geometry, which will necessitate calculation of LPC through re-analysis of the synthesized speech signals. In addition, even the thus calculated LPC contains distortions relative to the LPC obtained through the analysis of original speech and hence it will not ensure such good speech modification characteristics. On the contrary, the method of the reference 4 is capable of avoiding the occurrence of these distortions.

Conversely, this means that the technique disclosed in the reference 4 will face a problem of poor connectability, in other words, of impossibility of application to systems designed to synthesize the speech signals by use of a parameter group other than cepstrum parameters. Typical of such systems are, for example, ones using parameter groups such as LPC, LSP (line spectrum pairs), and PARCOR (partial autocorrelation coefficients). This problem is serious since the LPC, LSP and PARCOR are often used for speech coding/decoding. If a speech modification filter using mel-scaled cepstrum as its filter coefficient is incorporated into the synthesizing unit 200 receiving LPCs as one of parameters, then the spectral geometry will be distorted with the transformation from the LPC domain into the mel-scaled cepstrum domain, as described hereinbefore. It is natural that this distortion can be eliminated to some degree by again calculating the mel-scaled cepstrum through re-analysis of the synthesized speech signals. Even though the mel-scaled cepstrum has been calculated in this manner, however, it will still contain more distortions compared with the mel-scaled cepstrum which would be derived from the original speech. Thus, not very good speech modification characteristics are to be expected.

SUMMARY OF THE INVENTION

A first object of the present invention is to provide a speech modification (or enhancement, which will be omitted hereinafter) filter ensuring a good formant enhancement effect within a range of permissible spectral gradients. A second object of the present invention is to provide a speech modification filter ensuring a good formant enhancement effect without causing any perceptible level of distortion in the formant structure. A third object of the present invention is to provide a speech modification filter capable of implementing the same formant enhancement effect as the prior art by using a lower number of constituent means than the prior art. A fourth object of the present invention is to provide a speech modification filter allowing selective execution of the control of brightness, reduction in the processing procedures, improvement in intelligibility, etc. A fifth object of the present invention is to avoid the necessity of the stability proof in the domain whose nature is different from the domain to which the input spectral information belongs, and to thereby provide a speech modification filter having a high degree of freedom of design. A sixth object of the present invention is to provide a speech modification filter suitable for a synthesizing unit which receives LSP, PARCOR, LAR (log area ratio), etc., as spectral information from the analyzing unit side. A seventh object of the present invention is to provide a speech modification filter ensuring, upon the input of LSP, PARCOR, LAR, etc., as spectral information, a good connectability without the need for any spectrum re-analysis or parameter transform. It is an eighth object of the present invention to implement a speech synthesizing system by use of the speech modification filter which is able to achieve the above first to seventh objects.

According to a first aspect of the present invention, synthesized speech signals are filtered through a transfer function defined by a filter coefficient, to generate modified synthesized speech signals. This filter coefficient is generated on the basis of spectral information represented in the form of a multi-dimensional vector and belonging to a predetermined domain and pertaining to input speech signals, in such a manner that formant characteristics of the modified synthesized speech signals are enhanced in accordance with the above spectral information and in comparison with those of the synthesized speech signals. Available as the spectral information is any one of LSP information, PARCOR information and LAR information. Because of specific features of the LSP information, PARCOR information and LAR information, the operations for generating the filter coefficients can be performed as operations of such a nature that arithmetic associated with individual dimensions is dependent on arithmetic associated with the remaining dimensions. When using the LSP, PARCOR or LAR information to generate filter coefficients, the filter stability can be secured without transforming them from the LSP, PARCOR or LAR domain to another domain. Please note that in the filter using, for example, the filter coefficients generated from the LPC information, it is necessary to transform the filter coefficients from the LPC domain to another domain to prove the stability of the filter. In consequence, according to the first aspect of the present invention, it is easier to design the speech modification process or filter without introducing instability thereto, than the prior arts using the filter coefficients generated from the LPC information. In addition, application of this aspect to systems transmitting or storing the LSP information, PARCOR information, or LAR information would not need any spectrum re-analysis and parameter transformation, whereby a good connectability can be ensured.

The filtering in the present invention can be performed within any one of the LPC domain, LSP domain and PARCOR domain. In other words, the filter coefficients in the present invention can belong to any one of the LPC domain, LSP domain and PARCOR domain. According to a second aspect of the present invention, spectral information is first modified within a domain to which it belongs to generate modified spectral information, and the modified spectral information is then transformed from that domain into the LPC domain to generate filter coefficients, and the thus obtained filter coefficients are used for filtering within the LPC domain. Since a variety of modified coefficients can be employed for this modification, this aspect will make it possible to more freely modulate the filter coefficient synthesis than the prior arts, in accordance with filtering characteristics (synthesized speech signal modification characteristics) demanded by the users.

According to a third aspect of the present invention, the spectral information is so modified as to reduce the peaks of formants of the modified synthesized speech signals. Therefore this will make it possible to obtain a good formant enhancement effect within a range of permissible spectral gradients and to obtain a good formant enhancement effect without causing any perceptible level of distortions in the formant structure.

Conceivable as a first method for modification is a method in which the spectral information pertaining to the input speech signals and the reference information belonging to the same domain are proportionally divided in accordance with the modified coefficient. This method is available when the spectral information is LSP information. Depending upon the methods of setting the reference information, this method would make it possible to perform the following modifications, for example: a modification for imparting a fixed spectral gradient to the modified synthesized speech signals; a modification for imparting a spectrum gradient reflecting average noise spectrum to the modified synthesized speech signals (that is, a modification for slightly enhancing a speech spectrum other than the noise spectrum); and a modification for imparting to the modified synthesized speech signals a spectrum gradient reflecting a history which the spectral information has traced so far (that is, a modification for enhancing the amount of variation in the speech spectrum). This will make it possible to effect control of the brightness, reduction in the information processing procedures, and improvement in the intelligibility. This method also allows the filter of the present invention to further implement the characteristics of the other secondary filtering processes (for example, a fixed high-frequency enhancement process).

Conceivable as a second method for modification is a method in which for each of a plurality of dimensions constituting spectral information pertaining to input speech signals, that spectral information is multiplied by a modified coefficient, or by the power of the modified coefficient. This method is available when the spectral information is either PARCOR information or LAR information. This method also ensures some of the effect listed above, e.g. the reduction of process, the improved intelligibility, etc. It is to be understood that when the spectral information is the PARCOR information, use is made of the method multiplying the spectral information by the power of the modified coefficient and that said power is dependent on the dimension of the spectral information.

Conceivable as a third method for modification is a method in which distances are expanded between adjacent dimensions among a plurality of dimensions representative of the spectral information pertaining to the input speech signals. More specifically, when a distance between adjacent dimensions is less than a reference distance, the distance is expanded beyond the reference distance and thereafter said distance is equally shrunk with respect to all the dimensions so as to ensure that the extent of the spectral information in its entirety becomes coincident with the extent before expansion. This method is available when the spectral information is the LSP information. This method enables to modify the spectral information such that the spectrum of the modified synthesized speech signals is flattened and ensures some of the effect listed above, e.g. the reduced process, the improved intelligibility, etc. in terms of smoothing the spectral gradient. In addition, the reduction of the process or the components relative to the first and second methods is realized.

It can also be envisaged that the first and third modification methods are combined with each other. In that case, the first method and the third method may be selectively used, or alternatively, both may be used cooperatively. As to the advantages of each method relative to other two methods and differences between three methods, it will be apparent from the later description on embodiments for the person skilled in the art.

The first to third modification methods can be embodied as: firstly a translation table which stores spectral information about input speech signals in correlation with modified spectral information and generates the modified spectral information in response to a supply of the spectral information; and secondly, a neural network which has acquired, by learning, an ability to transform spectral information into modified spectral information so as to be able to generate the modified spectral information upon a supply of the spectral information about input speech signals. It is preferable that the translation table and the neural network be provided for each of a plurality of categories which do not overlap with each other and which are obtained by classifying domains to which spectral information about input speech signals belongs, or that they be used while switching their actions through the switching of coefficients for each category. This would make it possible to provide an adaptive control through the category division and reduce distortions at the boundaries of categories. It would also be possible to use any modification method other than the first to third methods for each category.

According to a fourth aspect of the present invention, in which filtering is executed within any one of the LSP domain and PARCOR domain, the spectral information about the input speech signals is modified within a domain to which it belongs and the resultant modified spectral information is used as a filter coefficient. This aspect will eliminate the need for the transform of domains associated with the modified spectral information, making it possible to provide substantially the same formant enhancement effect as the prior art by less number of constituent elements than the prior art.

According to a fifth aspect of the present invention, filtering is so executed that formants of the modified synthesized speech signals are further enhanced as compared with those of the synthesized speech signals. According to sixth aspect of the present invention, the spectral gradient to be imparted to the modified synthesized speech signals in the fifth aspect is suppressed.

According to a seventh aspect of the present invention, synthesized speech signals are generated on the basis of spectral information represented as a multi-dimensional vector and belonging to a predetermined domain and pertaining to input speech signals, and thereafter the processes involved with the above-described aspects are executed on the basis of the spectral information. According to an eighth aspect of the present invention, synthesized speech signals are generated on the basis of first spectral information represented as a multi-dimensional vector and belonging to a predetermined domain and pertaining to input speech signals, and the first spectral information is transformed into second spectral information belonging to a domain different from the domain to which the first spectral information has belonged so far, and then the processes involved with the above-described aspects are executed on the basis of the second spectral information. According to a ninth aspect of the present invention, synthesized speech signals are generated on the basis of first spectral information pertaining to input speech signals and belonging to a predetermined domain and represented as a multi-dimensional vector, and the synthesized speech signals are analyzed to generate second spectral information, and then the processes involved with the above-described aspects are executed on the basis of the second spectral information. According to a tenth aspect of the present invention, previous to the processes involved with the seventh to ninth aspects, spectral information or first spectral information is generated through the analysis of input speech signals, and the spectral information or the first spectral information is stored or transmitted.

DETAILED DESCRIPTION OF THE PREFERRED EMBODIMENTS

Figure 2:
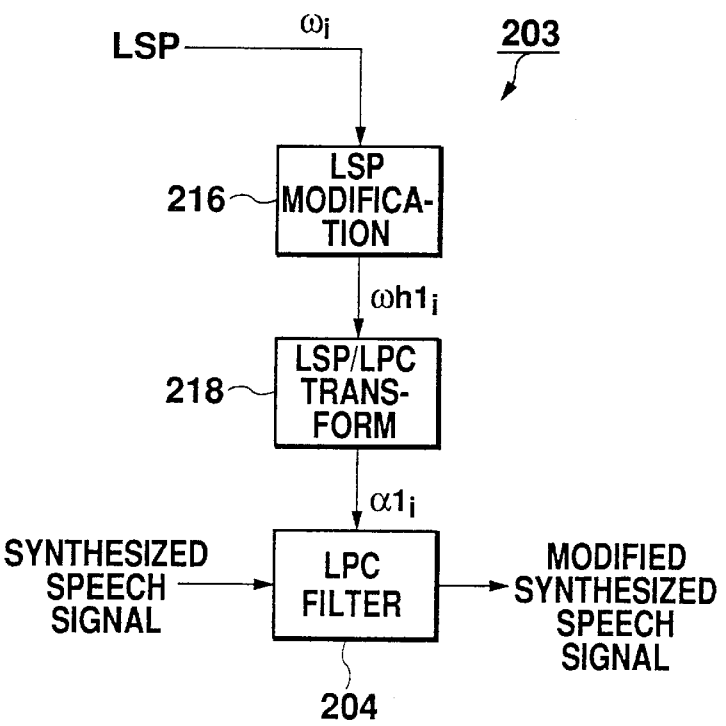
FIG. 1 and FIG. 2 are block diagrams each showing a configuration of a speech modification filter in accordance with an LSP-based embodiment among preferred embodiments of the present invention.

Embodiments of the present invention will now be described with reference to the accompanying drawings, in which constituent elements identical or corresponding to the prior art techniques shown in FIGS. 28 to 36 are designated by the same reference numerals and will not be further explained. It is to be noted that constituent elements common to respective embodiments are also designated by the same reference numerals and will not be repeatedly explained.

a) LSP-based Embodiment

Figure 1:
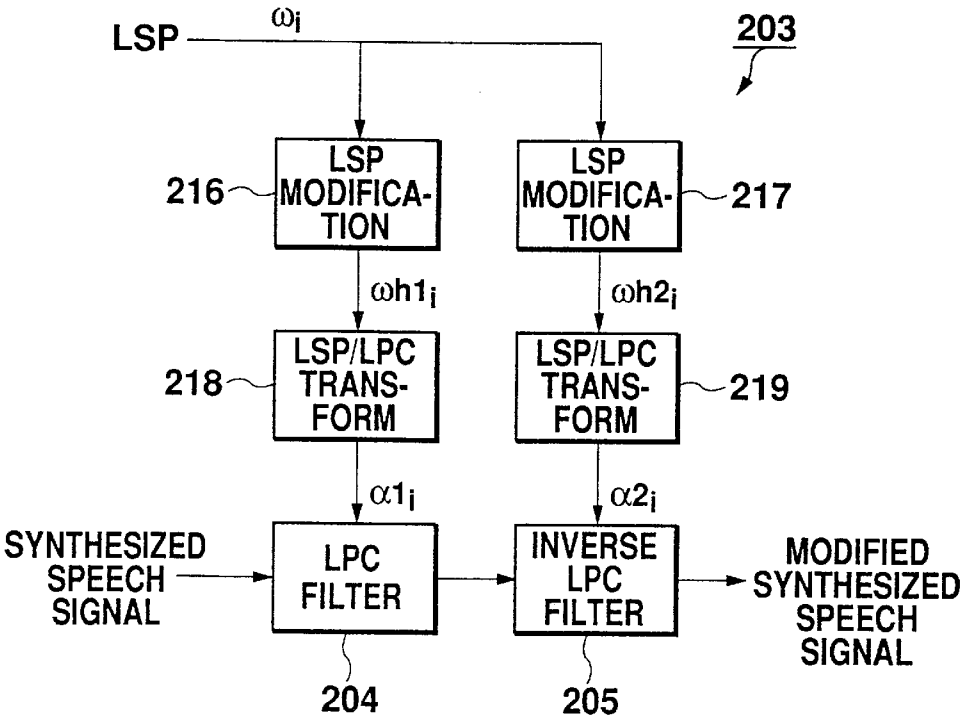

Referring first to FIGS. 1 and 2 there are depicted two embodiments receiving LSP as spectral information in decoded parameter group, among preferred embodiments of a filter 203 in accordance with the present invention. The embodiment shown in FIG. 1 comprises LSP modification sections 216 and 217 and LSP/LPC transform sections 218 and 219 in addition to the filters 204 and 205. Also the embodiment shown in FIG. 2 comprises the LSP modification section 216 and the LSP/LPC transform section 218 in addition to the filter 204.

Figure 3:
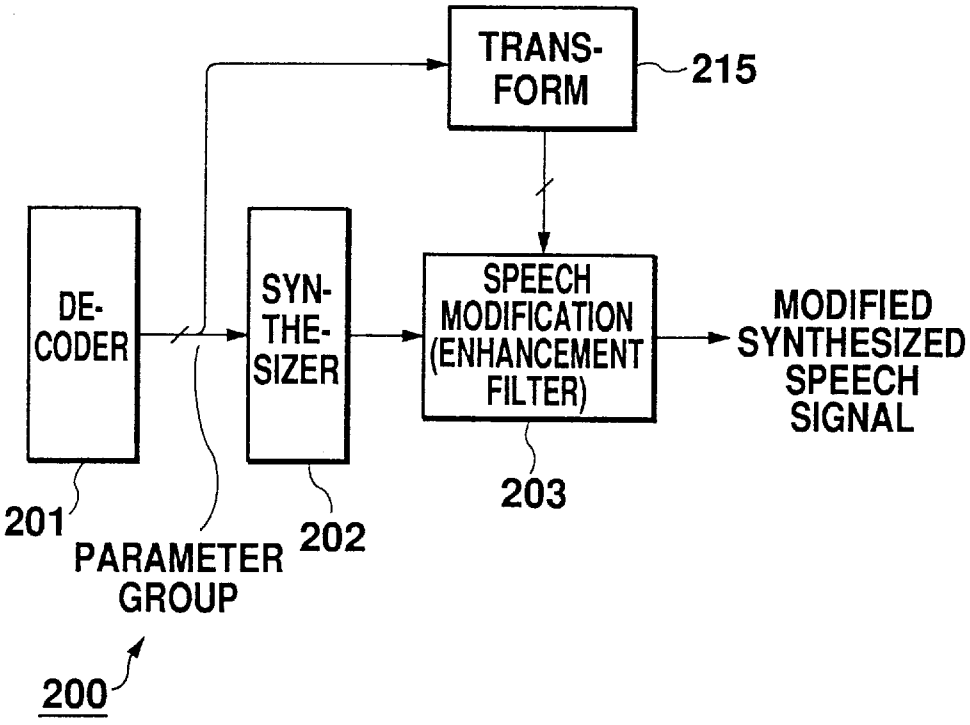
FIG. 3 is a block diagram showing, by way of example, a configuration of a speech analysis/synthesis system.
Figure 29:
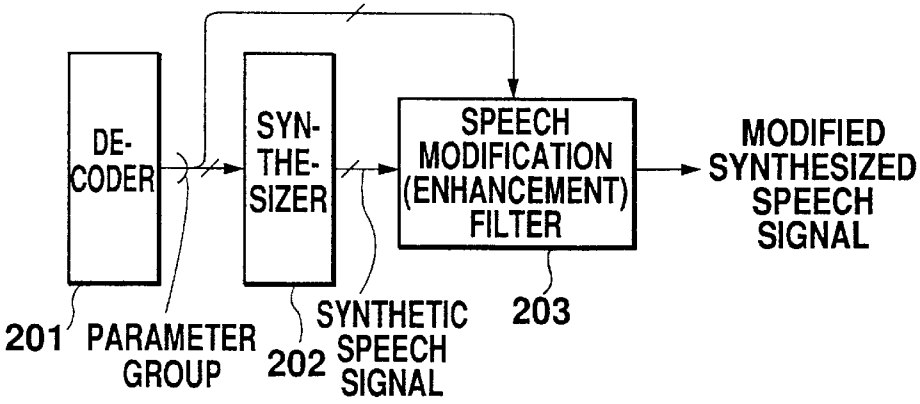
Fig. 29 PRIOR ART
FIG. 29 is a block diagram illustrating a manner of using a speech modification filter.
Figures 30, 33:
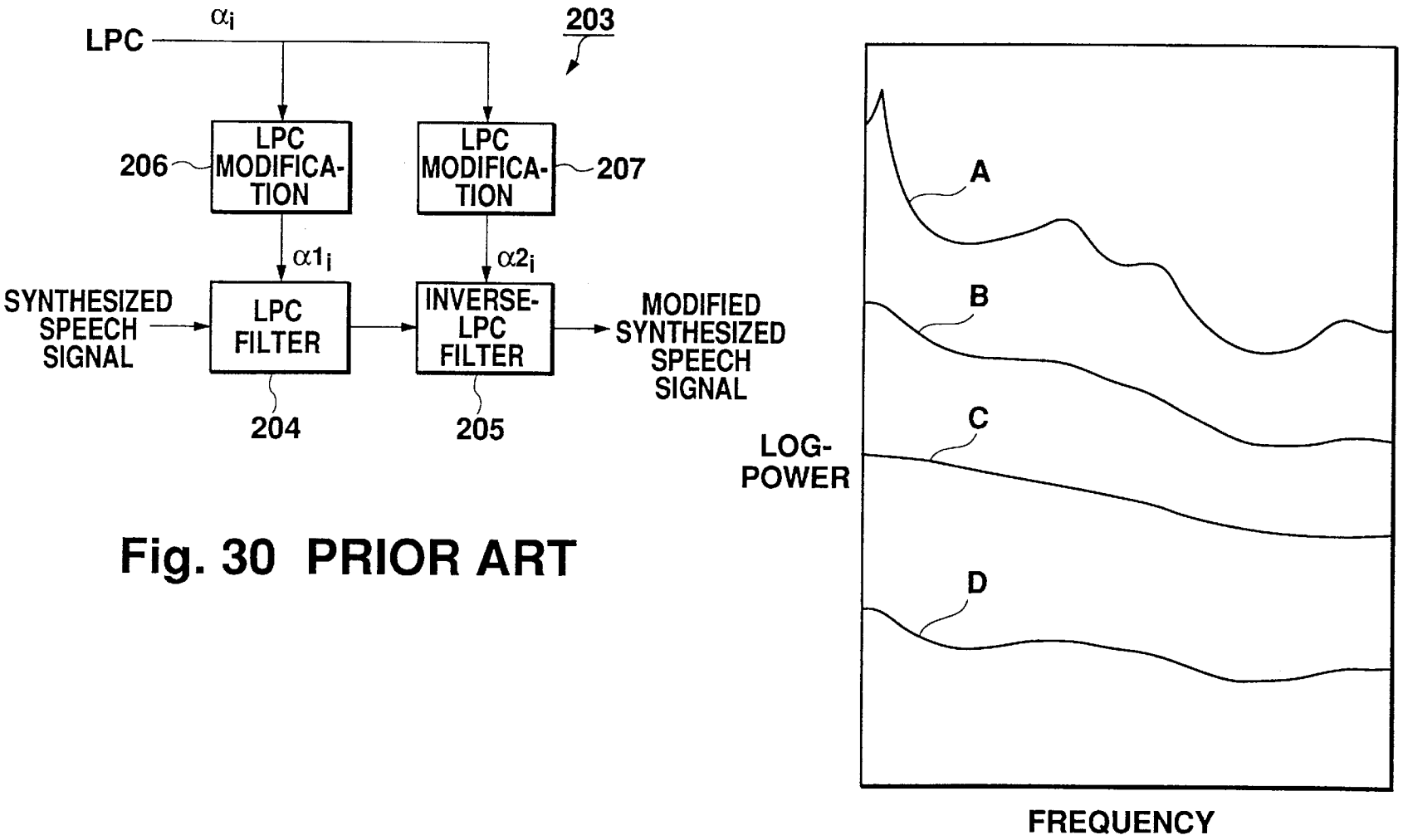
Fig. 30 PRIOR ART
Fig. 33 PRIOR ART
FIG. 30, FIG. 31 and FIG. 32 are block diagrams illustrating configurations of the speech modification filters disclosed in reference 1, reference 2 and reference 3, respectively.
FIG. 33, FIG. 34 and FIG. 35 are graphical representations of log-power vs. frequency spectrum characteristics of the speech modification filters disclosed in the reference 1, reference 2 and reference 3, respectively.

These embodiments can be used in the synthesizing unit 200 having a configuration as shown in FIGS. 30 or 3. In the case of using the decoder 201 able to output LSP as an element of parameter group, the filter 203 can directly receive the output from the decoder 201 as shown in FIG. 29, whereas in the case of using the decoder 201 which is not capable of outputting LSP information as an element of parameter group, the output from the decoder 201 must be transformed through a transform section 215 into the LSP domain and then supplied into the filter 203, as shown in FIG. 3. It is to be appreciated that the transform section 215 may be integrated into the decoder 201 or the synthesizer 202.

The LSP modification sections 216 and 217 receive LSP $\omega_i$ in the form of a multi-dimensional vector from the decoder 201 or transform section 215 and modifies $\omega_i$ in conformity with a predetermined method to generate modified LSP $\omega h\mathbf{1}_i$ and $\omega h\mathbf{2}_i$, respectively. The LSP/LPC transform sections 218 and 219 transform $\omega h\mathbf{1}_i$ and $\omega h\mathbf{2}_i$, respectively, from the LSP domain into the LPC domain to generate modified $\alpha$ parameters $\alpha\mathbf{1}_i$ and $\alpha\mathbf{2}_i$, respectively. The filters 204 and 205 perform, in series, filtering of synthesized speech signals using $\alpha\mathbf{1}_i$ and $\alpha\mathbf{2}_i$, respectively, as their respective filter coefficients. As a result, the filter 205 provides modified synthesized speech signals as its output. Now, let the transfer functions of the filters 204 and 205 be $1/A_1(z)$ and $A_2(z)$, respectively, then the transfer function of the filter 203 of FIG. 1 can be given as $$H(z)=A_2(z)/A_1(z) \tag{3}$$

and the transfer function of the filter 203 of FIG. 2 can be given as $$H(z)=1/A_1(z) \tag{4}$$

In the LSP-based embodiment of the present invention, in this manner, LSP $\omega_i$ received as one of parameters is modified and the modified LSP $\omega h\mathbf{1}_i$ (and LSP $\omega h\mathbf{2}_i$) are transformed from the LSP domain into the LPC domain to thereby generate filter coefficients $\alpha\mathbf{1}_i$ (and $\alpha\mathbf{2}_i$) which are modified $\alpha$ parameters. A first advantage of the thus obtained LSP-based embodiment lies in that it is easy to prove and secure the filter 203 stable, since the stability can be checked within LSP domain. More specifically, it is generally known that the filter using the LSP $\omega_i$ is stable when the LSP $\omega_i$ satisfies following sequential condition:

$$0<\omega_1<\omega_2<\ldots<\omega_p<\Pi \tag{5}$$

Therefore, so long as the LSP satisfying equation (5) is used as the filter coefficient, the process for generating $\alpha_{1i}$ and $\alpha_{2i}$ can be performed independently for respective i, without introducing the instability to the filter. As a result, a high degree of freedom of the filter design is realized. For example, it is capable of implementing a filter which can enhance the high-frequency components of the speech, by setting the degree of enhancement for the high-order dimensions to relatively large value. On the contrary, in the case where the $\alpha$ parameter or the autocorrelation constant is used to generate filter coefficient, only the process with proof that it would not introduce the instability to the filter can be used to generate $\alpha_{1i}$ and $\alpha_{2i}$, as in references 1 to 3, since in the $\alpha$ parameter domain or in the autocorrelation domain, it is difficult to prove and secure the stability of the filter using the filter coefficients based on such parameters. Accordingly, the modification process performed for respective i or with adjustment of the degree of enhancement along the frequency axis can not be performed without allowing the introduction of the instability to the filter when the $\alpha$ parameter based or the autocorrelation based filter coefficients are used.

A second advantage of the LSP-based embodiment lies in a higher applicability to the systems transmitting or storing the LSP as the spectral information. Most of the speech coding/decoding systems in particular which have been developed in recent years tend to use the LSP as the spectral information. The LSP-based embodiment of the present invention is easily applicable to such types of speech coding/decoding system. That is, due to the fact that there is no need for re-analysis of the spectrum and transformation of parameters, a good connectability can be obtained to such type of systems, unlike the prior art where the filter coefficients are determined on the basis of input mel-scaled cepstrum as disclosed in the reference 4.

As is apparent from the above description, the transfer function H (z) of the filter 203 in the LSP-based embodiment of the present invention will depend on the manner of performing the LSP modifying operation and LSP/LPC transforming operation to obtain the filter coefficients $\alpha\mathbf{1}_i$ and $\alpha\mathbf{2}_i$. A preferred method for the LSP modifying operation is firstly a proportional division modification and secondly an adjacent dimension-to-dimension distance expansion.

Figure 4:
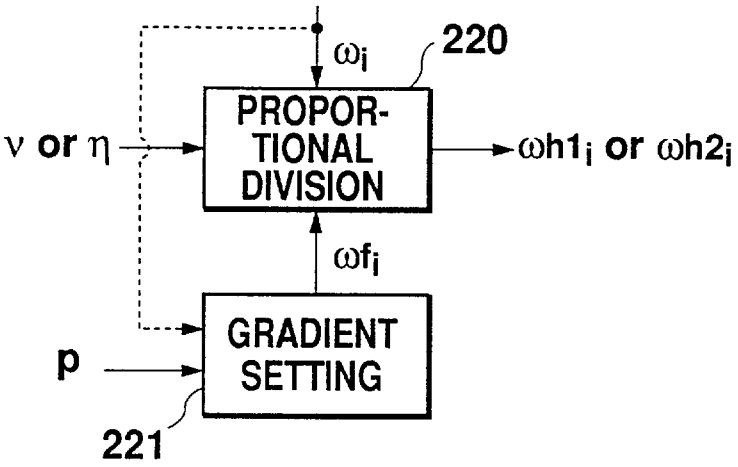
FIG. 4 is a block diagram showing an example of an LSP modification method.

The proportional division modification mentioned first is a method in which $\omega_i$ is proportionally divided using modified coefficients $\nu$, $\eta$ satisfying $0\leqq\nu\leqq\eta<1$ as proportional division ratios. When this method is executed in the configuration of FIG. 1, the LSP modification sections 216 and 217 each have a functional configuration including a proportional division operating section 220 and a gradient setting section 221 as shown in FIG. 4 for example. The proportional division operating section 220 generates $\omega h\mathbf{1}_i$ or $\omega h\mathbf{2}_i$ in accordance with the following expression for proportional division:

$$\omega h\mathbf{1}_i=\omega_i\times(1-\nu)+\omega f_i\times\nu \text{ or} \tag{6}$$
$$\omega h\mathbf{2}_i=\omega_i\times(1-\eta)+\omega f_i\times\eta$$

where i=1, 2, . . . p.

The gradient setting section 221 sets $\omega f_i$ in the proportional division operating section 220 on the basis of the linear prediction order p. It is to be appreciated that $\omega f_i$ used in the LSP modification section 216 may be different in value from $\omega f_i$ of section 217. Also the modification of $\omega f_i$ through the proportional division may be applied to the configuration of FIG. 2.

A first advantage of the proportional division is to ensure an improved formant enhancement effect. That is, when $\omega h\mathbf{1}_i$ and $\omega h\mathbf{2}_i$ generated through the proportional division are transformed from the LSP domain into the LPC domain, formants become dull with the result that a good formant enhancement effect can be obtained. "Formants become dull" herein means that "peaks of formants become small", in other words, "spectral characteristics flatten while leaving the spectrum having a somewhat peak-valley structure".

A second advantage of the proportional division is to ensure a high degree of freedom of designing characteristic in conformity with demands of the users, such as varying the degree of modifying the synthesized speech signals for each frequency band. In particular, by designing $\omega f_i$ besides $\nu$ and $\eta$, the characteristics of the filter 203 can be varied so as to well meet the demands of the users. This high degree of freedom of design will lead to an effect that within a range of permissible spectral gradients a better formant enhancement effect surpassing the conventional techniques can be easily obtained.

It is envisaged that there are several methods of setting $\omega f_i$. A first method is to set LSP representative of a flat spectrum as $\omega f_i$ The gradient setting section 221 implemented in conformity with this method sets $\omega f_i$ in such a manner that $\omega f_i$ adjacent dimension-to-dimension distance ($=\omega f_i-\omega f_{i-1}$) results in a certain value represented as $\pi/(p+1)$, in accordance with the following expression $$\omega f_i=\pi\times i/(p+1) \tag{7}$$

Figure 5:
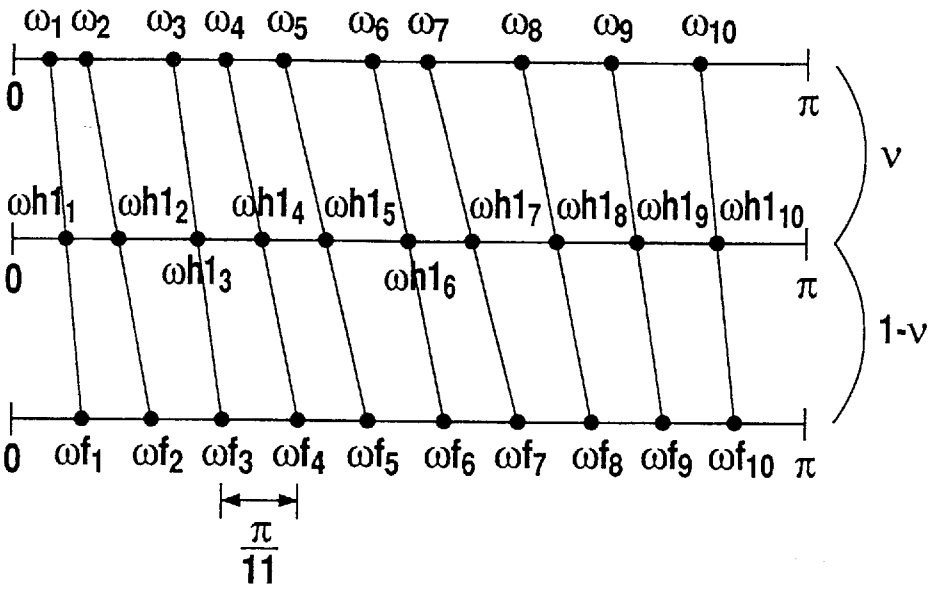
FIG. 5 is an explanatory diagram of a method of generating modified LSP through a proportional division.

FIG. 5 conceptually illustrates $\omega h1_i$ generation as an example, the modifying-by-proportional-division operation which will take place when setting $\omega f_i$ in accordance with the expression (7). Note that an assumption of p=10 is made herein. This method has the advantage of its functional simplicity in the gradient setting section 221.

A second method is to set LSP representative of a fixed gradient spectrum as $\omega f_i$. The gradient setting section 221 implemented in conformity with this method sets $\omega f_i$ in such a manner that the $\omega f_i$ adjacent dimension-to-dimension distance linearly increases or decreases in accordance with the following expression obtained by adding the term $\delta$ (i) depending i to the right side of the expression (7)

$$\omega f_i=\pi\times i/(p+1)+\delta(i) \tag{7a}$$

In this case it could easily be seen by those skilled in the art from the above description and the disclosure of FIG. 5 how the proportion division modification action takes place. This method firstly has the advantage of allowing the brightness to be controlled through the setting of proportional coefficient of $\omega_i$ since a substantially fixed gradient can be imparted to the characteristics of the filter 203. It secondly has the advantage of allowing the processing procedures to be reduced since the transfer function H (z) of this filter 203 can contain the characteristics of a fixed high-frequency enhancement process which may be carried out almost simultaneously with the ordinary formant enhancement process. It thirdly has the advantage of being capable of applying it to suppress the brightness variation by changing $\delta$ (i) to $\delta$ ($\omega_i$) and modifying its functional block by dotted line in FIG. 4.

Figure 6:
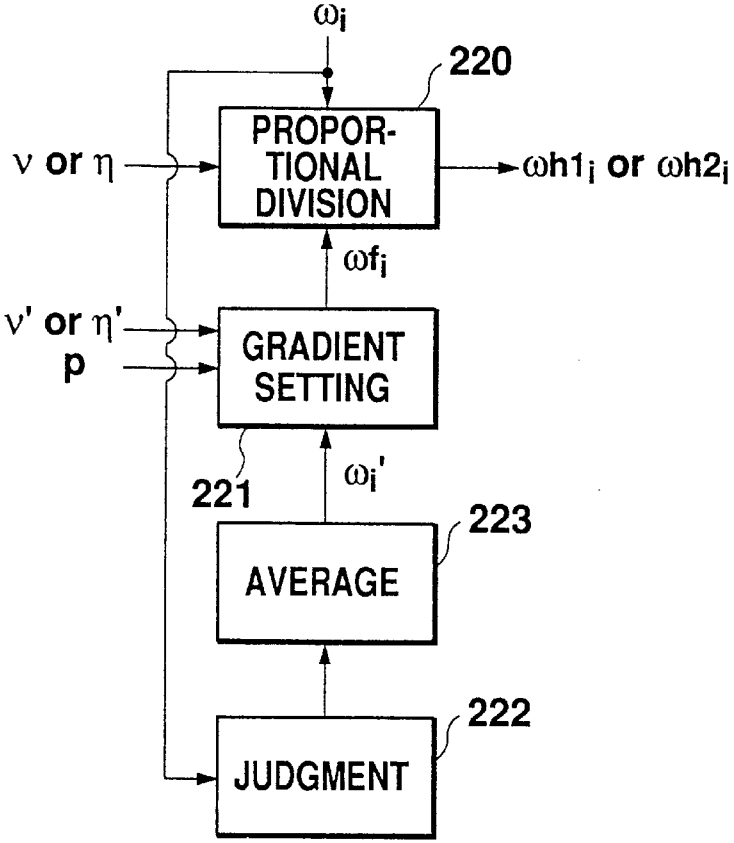

A third method is to set as $\omega f_i$ an LSP obtained by modifying the LSP representative of an average noise spectrum through, for example, the proportion division process. The gradient setting section 221 implemented in conformity with this method sets $\omega f_i$, as shown in FIG. 6, by modifying LSP $\omega_i'$ representative of the average noise spectrum on the basis of the proportional division ratio $\nu'$ or $\eta'$, in accordance with the following expression $$\omega f_i=\omega_i'\times(1-\nu')+\omega_i'\times\nu' \text{ or}$$

$$\omega f_i=\omega_i'\times(1-\eta')+\omega_i'\times\eta' \tag{7b}$$

where i=1, 2, . . . p.

The advantage of this method lies in improved intelligibility due to the ability to somewhat enhance the speech spectrum instead of the noise spectrum. Incidentally $\omega_i'$ can be obtained by averaging, through an average operation section 223, $\omega_i$ within a period which has been judged to be a noise period by a judgment section 222 shown in FIG. 6. It is also preferable that the modification process which $\omega_i'$ undergoes be set so as not to impart too extreme a spectral variation to the modified synthesized speech signals. For example, if $\omega f_i$ is made too dull, it will become possible to prevent any extreme spectral variation from occurring in the modified synthesized speech signals.

Figure 7:
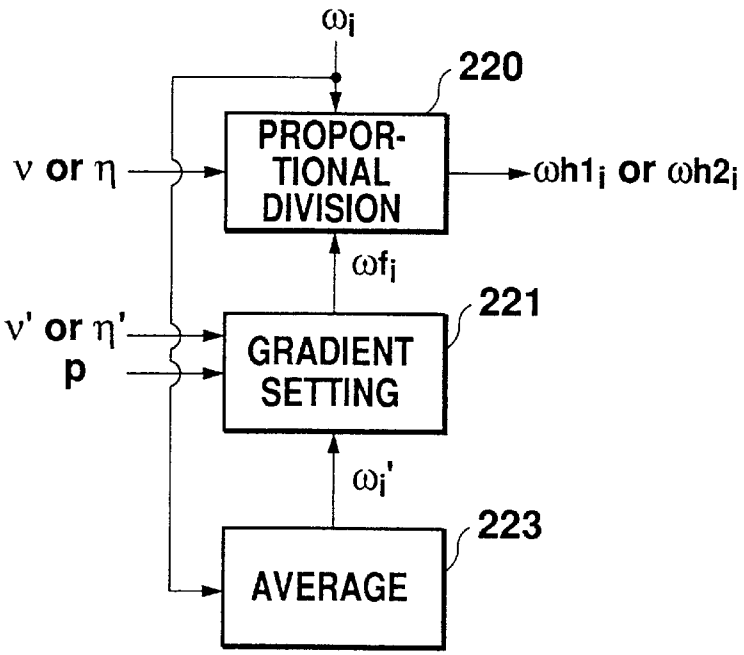
FIG. 6 and FIG. 7 are block diagrams each showing an example of the LSP modification method.

A fourth method is to set as $\omega f_i$ an LSP obtained by modifying, for example through the proportional division process, an average value of $\omega_i$ during a period up to now after the start of action or during a past predetermined period. As shown in FIG. 7, the gradient setting section 221 implemented by this method finds an average value $\omega_i'$ of the past LSP $\omega_i$ through the average operation section 223 and sets $\omega f_i$ on the basis of this $\omega_i'$ and the proportional division ratio $\nu'$ or $\eta'$ and in accordance with the expression (7b). The advantage of this method lies in improved intelligibility attributable to the ability to enhance variations in the speech spectrum. It is also preferable for the execution of this method that consideration be taken for example to modify $\omega_i'$ so as not to impart spectral variations that are too extreme to the modified synthesized speech signals.

Figure 8:
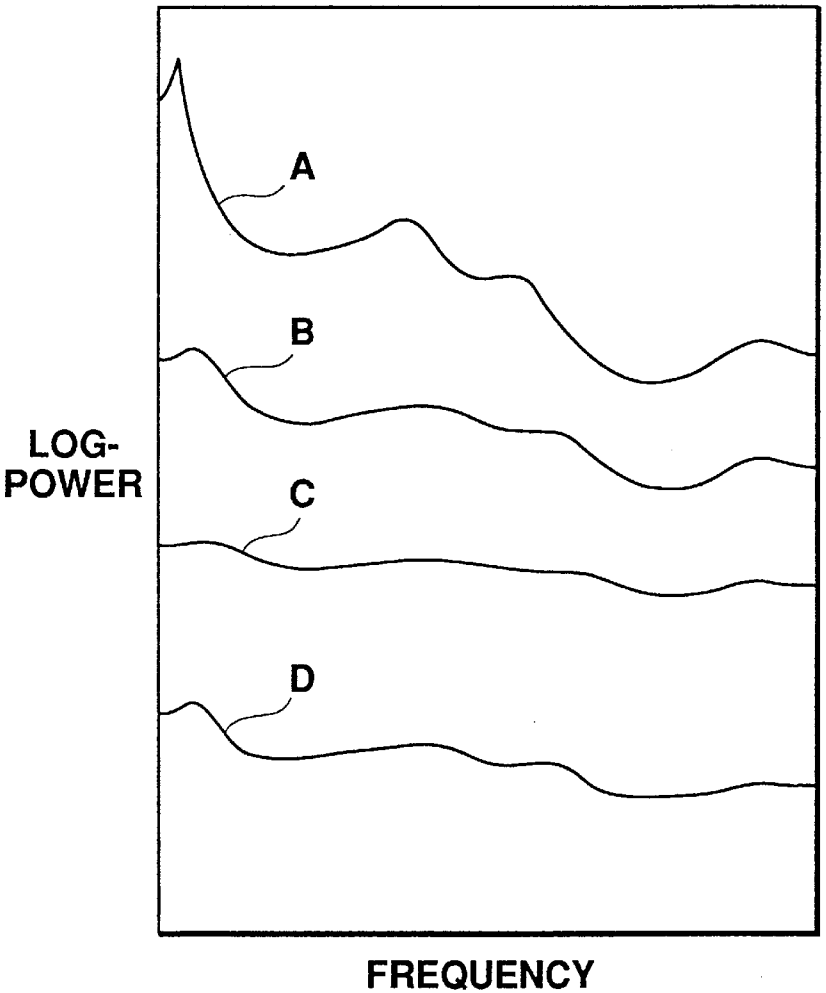
FIG. 8 is a graphical representation of log-power vs. frequency spectrum characteristics of the LSP-based embodiment among the preferred embodiments of the present invention, which characteristics are obtained in the case of using a method of generating the modified LSP through the proportional division in the FIG. 1 configuration.

Referring then to FIG. 8 there are depicted log-power vs. frequency spectrum characteristics of the filter 203 shown in FIG. 1, which will appear when $\omega_i$ is modified in accordance with the expressions (6) and (7). In the graph, A, B, C and D respectively represent the synthesizer 202 characteristics= 1/A (z), the filter 204 characteristics=$1/A_1$ (z), the filter 205 inverse-characteristics=$1/A_2$ (z), and the filter 203 transfer function H (z)=$A_2$ (z)/$A_1$ (z) with $\nu$=0.5 and $\eta$=0.8. As shown in this graph, the characteristic D of this graph is flattened while leaving the spectrum peak-valley structure to a certain extent, in comparison with the characteristic D of FIG. 33. In FIG. 8 in this manner, a better formant enhancement effect can be seen compared with FIG. 33. Also the characteristic D of this graph presents less distortions, with respect to the spectrum peak-valley structure, than the characteristics D of FIG. 34. Furthermore, the characteristic D of this graph no longer presents the two phenomena which have been observed in the characteristics B and C of FIG. 35, that is, displacement of formants at lowest frequency and integration of two formants in the middle. As an alternative to the proportional division process, the other process having an effect of dulling the formants in the LSP domain may be employed to obtain similar advantages.

The present inventor has aurally compared the modified synthesized speech derived from the filer 203 of this embodiment modifying $\omega_i$ in accordance with the method represented by the expressions (6) and (7), with the modified synthesized speech derived from the filter 203 of the prior art described earlier. As a result, it has turned out that the speech modification filter of this embodiment presents an advantage over the prior art filter in terms of suppression of brightness degradation and that the former does not cause any unique distorted speech or any fluctuating tone.

Figure 9:
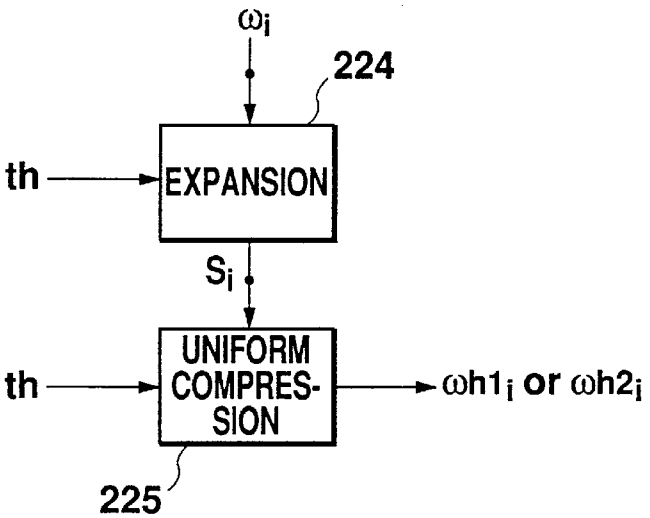
FIG. 9 is a block diagram showing an example of the LSP modification method.

The adjacent dimension-to-dimension distance expansion which is a second preferred embodiment of the LSP modifying operation can be executed by an expansion section 224 and a uniform compression section 225 as shown in FIG. 9. The expansion section 224 generates $s_i$ by shifting $\omega_i$, where both of $s_i$ and $\omega_i$ belong to LSP domain, so that the adjacent dimension-to-dimension distance $s_i-s_{i-1}$ can be made larger than the adjacent dimension-to-dimension distance $\omega_i-\omega_{i-1}$ (with respect to $\omega_i-\omega_{i-1}$, see FIG. 5). The uniform compression section 225 finds $\omega h1_i$ from $s_i$. It is to be noted in particular that $s_i$, as well as $\omega_i$, is a multi-dimensional vector. When this method is executed in the configuration of FIG. 2, the uniform compression section 225 finds $\omega h1_i$ in accordance with the following expression $$\omega h1_i = s_i / s_{p+1} \times \pi \quad (8)$$

and the expansion section 224 finds $s_i$ in accordance with the following expression $$s_i = s_{i-1} + \max(\omega_i - \omega_{i-1}, th) \quad (9)$$

where i=1, 2, . . . , p+1

$\omega_0=0$, $\omega_{p+1}=\pi$, $s_0=0$ th: threshold value

As is apparent from the above-described expressions (8) and (9), the adjacent dimension-to-dimension distance expansion is a process for securing at least a distance th between the (i−1)th dimension and the i-th dimension from the result of comparison of $\omega_i - \omega_{i-1}$ with th, as defined in particular by the second term on the right side of the expression (9). This process allows LSP associated with (i+1)th or upper dimensions to shift together upwardly by a distance corresponding to th-$(\omega_i - \omega_{i-1})$. Also the factor $\pi/s_{p+1}$ contained in the right side of the expression (8) is a factor for uniformly compressing the adjacent dimension-to-dimension distances in response to ratios in the $\omega_i$ range 0 to $\pi$ and in the $s_i$ range 0 to $s_{p+1}$ of the LSP. It will be understood that the present invention should not be construed to be limited by this defining expression, and that other defining expressions may be employed as long as they represent processes for expanding smaller adjacent dimension-to-dimension distances. Also $\omega_i$ by the adjacent dimension-to-dimension distance expansion may be applied to the configuration of FIG. 1. This would make it possible to further increase the degree of freedom of design of characteristics of the filter 203.

Figure 10:
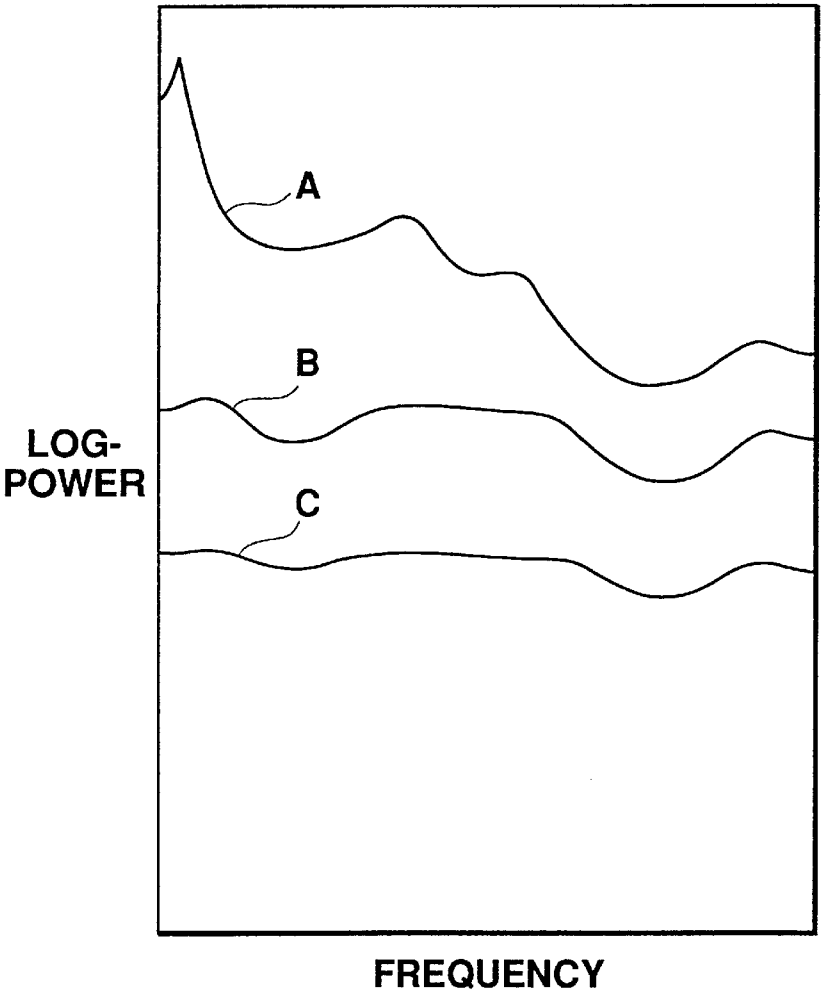
FIG. 10 is a graphical representation of log-power vs. frequency spectrum characteristics of the LSP-based embodiment among the preferred embodiments of the present invention, which characteristics are obtained in the case of using a method of generating the modified LSP through the expansion of distances between adjacent dimensions in the FIG. 2 configuration.

Referring next to FIG. 10 there are depicted log-power vs. frequency spectrum characteristics which will appear when this method is applied to the filter 203 of FIG. 2. In the graph, A, B and C respectively represent the synthesizer 202 characteristics=1/A (z), the filter 204 (th=0.3) characteristics=1/A1 (z; th=0.3) and the filter 204 (th=0.4) characteristics=1/A1 (z; th=0.4). As is apparent from this graph, this method allows characteristics comparable to FIGS. 33 and 34 to be presented by the filter 204 only (in other words, without using the filter 205 or any constituent element corresponding thereto). This means that a good speech modification filter can be implemented with a lower order filter than that of the known filters and that substantially the same formant enhancement effect as the conventional filters can be realized by a lower number of constituent elements. Furthermore the present inventor has aurally compared the modified synthesized speech obtained in this embodiment with that obtained in the traditional techniques. As a result, it has turned out that use of the speech modification filter of this embodiment will ensure a tone quality by no means inferior to that of the existing filters.

Figure 11:
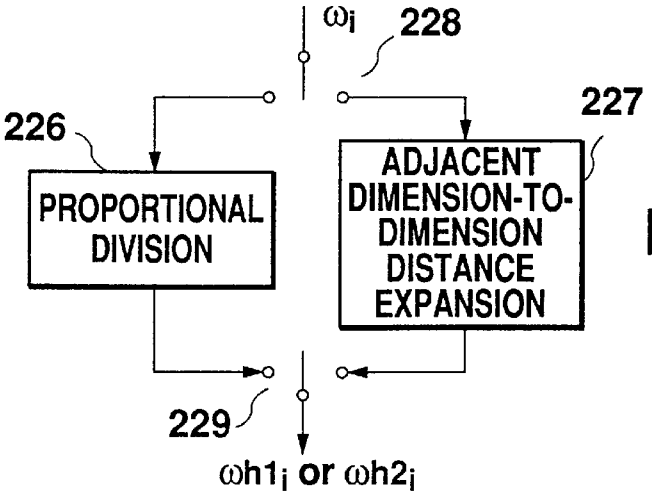
FIG. 11, FIG. 12, FIG. 13, FIG. 14, FIG. 15 and FIG. 16 are block diagrams each showing an example of the LSP modification method.
Figure 12:
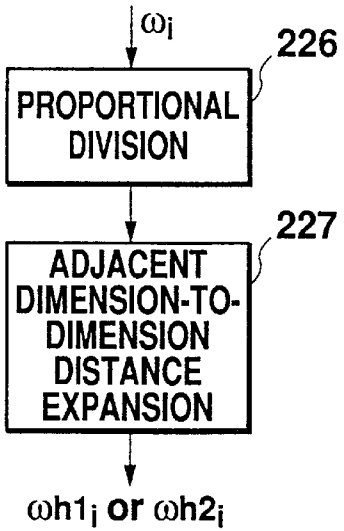

The two kinds of modification methods, that is, the proportional division modification and the adjacent dimension-to-dimension expansion are not mutually exclusive and hence they may be used in cooperation. It is also conceivable for example that one of the LSP modification sections 216 and 217 executes the proportional division, the other being in control of the adjacent dimension-to-dimension expansion. Alternatively, as shown in FIG. 11, a configuration may be employed which includes switching means 228 and 229 for selectively using the proportional division modification section 226 serving to modify $\omega_i$ through the proportional division and the adjacent dimension-to-dimension distance expansion section 227 serving to expand the adjacent dimension-to-dimension distances of LSP. The proportional division modification section 226 may have any one of the above-described configurations shown in FIGS. 4, 6 and 7. Alternatively, as shown in FIG. 12, a configuration could be employed in which the proportional division modification section 226 is connected in cascade with the adjacent dimension-to-dimension distance expansion section 227. By virtue of such configurations having a single LSP modification section serving both as the proportional division modification section 226 and the adjacent dimension-to-dimension distance expansion section 227, the degree of characteristic design of freedom of the filter 203 can be further increased. It may also be envisaged that the sequence of the proportional division modification section 226 and the adjacent dimension-to-dimension distance expansion section 227 shown in FIG. 12 is reversed. It is natural that other processes could be combined with both or either one of the proportional division modification and the adjacent dimension-to-dimension distance expansion.

Figure 13:
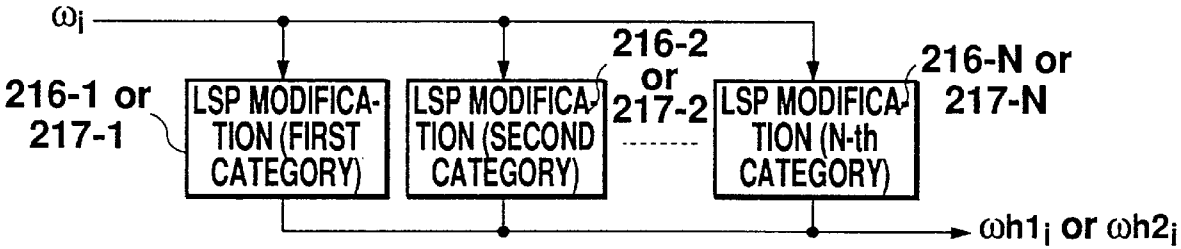
Figure 14:
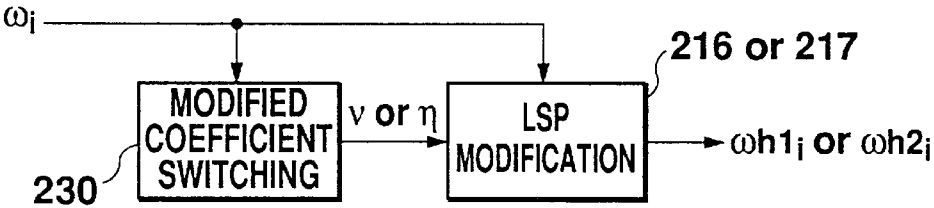

Furthermore an $\omega_i$ adaptive process may be executed by the LSP modification sections 216 and 217. Conceivable as a method for rendering the proportional division based $\omega_i$ modification process $\omega_i$ adaptive is for example a method in which an $\omega_i$ space is divided into a plurality of subspaces (hereinafter referred to as categories) not overlapping one another and in which $\nu$ and $\eta$ are prepared (or switched) for each category. In this case, the LSP modification section may be provided for each category, for example, an LSP modification section 216-1 (or 217-1) corresponding to a first category, an LSP modification section 216-2 (or 217-2) corresponding to a second category, . . . and an LSP modification section 216-N (or 217-N) corresponding to an N-th category (see FIG. 13). Alternatively, a single LSP modification section 216 (or 217) may be prepared together with a modified coefficient switching section 230 serving to switch $\nu$ and $\eta$ in response to the categories or i (see FIG. 14). The $\omega_i$ adaptive process has the advantage of realizing a flexible process which, for example, allows formant enhancement to be weakened only for a specified category such as a category causing distortions when the formant enhancement is raised. This would ensure a uniform or distortion-less improvement in the characteristics of the filter 203. It will be appreciated that since $\omega_i$ is a multi-dimensional vector the category referred to herein is in generally a multi-dimensional vector space.

Figure 15:
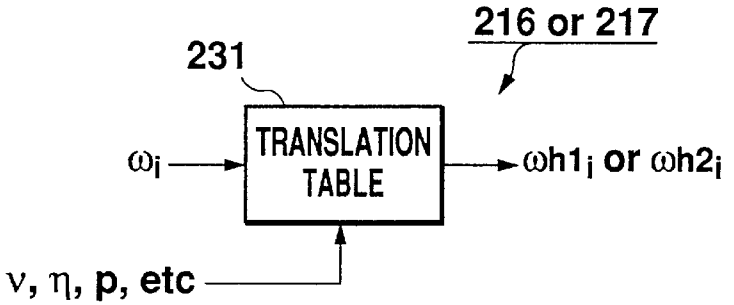

It is preferable that the $\omega_i$ modifying process in the LSP modification sections 216 and 217 be implemented by use of a translation table 231 as shown in FIG. 15. More specifically, the translation table 231 for correlating $\omega_i$ with $\omega h1_i$ or $\omega h2_i$ is prepared, allowing the LSP modification section 216 or 217 to orovide $\omega h1_i$ or $\omega h2_i$ as its output when $\omega_i$ is conferred. The advantage of utilizing the translation table 231 lies in a reduction of processing time. This advantage will become more or less remarkable if a relatively complex expression is used as a principle expression for the $\omega_i$ modification process.

Figure 16:
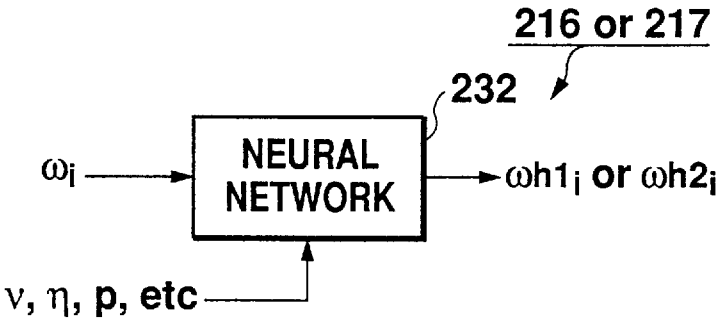
Figure 18:
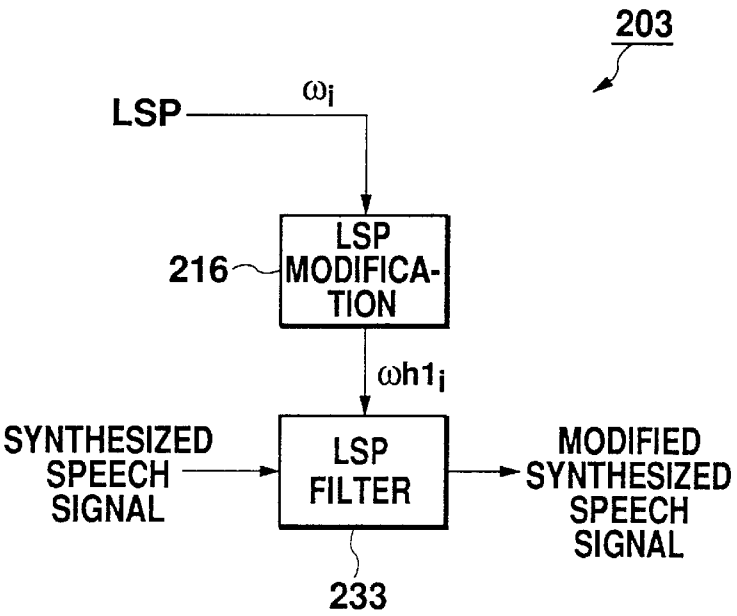
FIG. 17 and FIG. 18 are block diagrams each showing a configuration of a speech modification filter in accordance with an embodiment executing filtering within LSP domain, among the preferred embodiments of the present invention.
Figure 17:
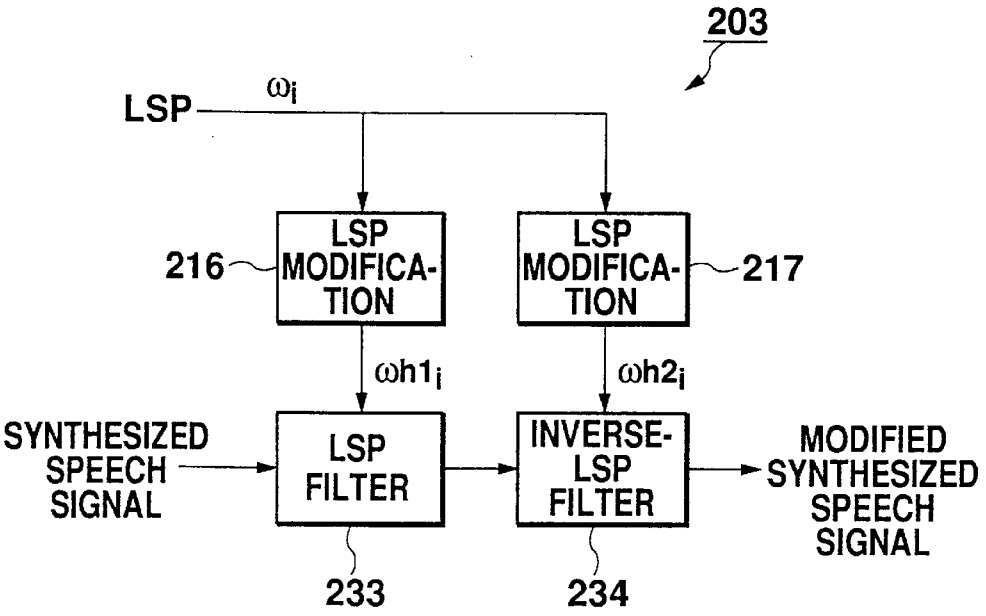
Figures 19, 20:
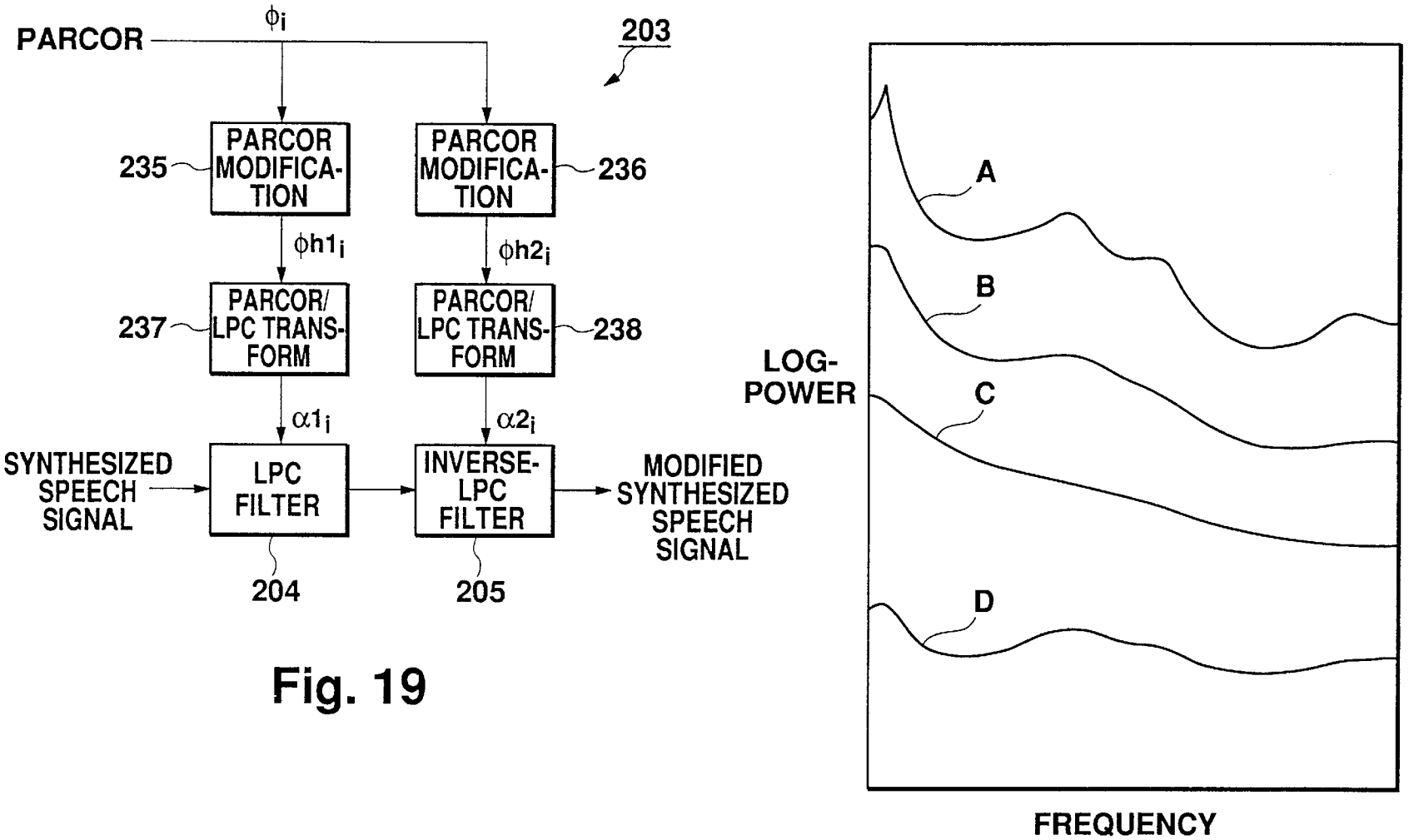
FIG. 19 is a block diagram showing a configuration of a speech modification filter in accordance with a PARCOR-based embodiment among the preferred embodiments of the present invention.
FIG. 20 is a graphical representation of log-power vs. frequency spectrum characteristics of the PARCOR-based embodiment among the preferred embodiments of the present invention.

The $\omega_i$ modifying process in the LSP modification sections 216 and 217 may be implemented by a neural network 232 which has previously learned $\omega_i$ modification characteristics conferred by for example the expression (6) as shown in FIG. 16. A first advantage of utilizing the neural network 232 lies in a reduction of processing time. This advantage will become more remarkable if a relatively complex expression is used as a principle expression for the $\omega_i$ modification process. A second advantage of utilizing the neural network 232 lies in that a memory capacity can be reduced due to the fact that there is no need to store the translation table 231 compared with the case of utilizing the translation table 231.A third advantage of utilizing the neural network 232 lies in the reduction of distortion. For example, in $\omega_i$ adaptive embodiments shown in FIGS. 13 and 14, distortions often appear at a boundary of categories in the modified or semi-modified synthesized speech signal, due to abrupt change of $\nu$ and $\eta$ arising from a slight variation of $\omega_i$ beyond the category boundary. The distortions tend to become noticeable, in particular when the division of $\omega_i$ space is relatively rough. In translation table embodiment shown in FIG. 15, distortions often appear at a boundary of table address, in the same way as FIGS. 13 and 14 embodiments. On the contrary, in the neural network embodiments shown in FIG. 16, no distortion occurs, since there is no category which causes the abrupt change in $\nu$ and $\eta$.The LSP-based embodiment of the present invention is not intended to be limited to the configuration which performs LPC filtering and inverse-LPC filtering, and would allow parameters other than LPC to be used as its filter coefficients. For example, as shown in FIGS. 17 and 18, the present invention could be implemented by use of an LSP filter 233 (and an inverse-LSP filter 234) utilizing as the filter coefficient $\omega h1_i$ (and $\omega h2_i$) as it is. The advantage of this configuration lies in that there is no need for the LSP/LPC transform sections 218 and 219.

b) PARCOR-based EmbodimentReferring now to FIG. 19, an embodiment entering PARCOR as spectral information is depicted. This embodiment comprises PARCOR modification sections 235 and 236 and PARCOR/LPC transform sections 237 and 238 in addition to the LPC filter 204 and the inverse-LPC filter 205. The PARCOR modification section 235 enters PARCOR $\phi_i$ as the spectral information from the decoder 201 or the transform section 215 and modifies this $\phi_i$ to generate modified PARCOR $\phi h1_i$. In the same manner, the PARCOR modification section 236 generates modified PARCOR $\phi h2_i$. The PARCOR/LPC transform section 237 transforms $\phi h1_i$ from a PARCOR domain into an LPC domain to generate a filter coefficient $\alpha 1_i$ for the LPC filter 204. The PARCOR/LPC transform section 238 also transforms $\phi h2_i$ from the PARCOR domain into the LPC domain to generate a coefficient $\alpha 2_i$ for the inverse-LPC filter 205.The PARCOR modification sections 235 and 236 generate $\phi h1_i$ and $\phi h2_i$ respectively, using modified coefficients $\nu$ and $\eta$ satisfying, for example, $0 \leqq \eta \leqq \nu < 1$, and in accordance with the following expressions $$\phi h1_i = \phi_i \times \nu^{(i \times i)}$$

$$\phi h2_i = \phi_i \times \eta^{(i \times i)} \tag{10}$$

where i=1, 2, . . . , p.Execution of such modification enables formants to dull on the PARCOR domain.In consequence, this embodiment will ensure the same characteristic improvement effect as that of the above LPC-based embodiment (e.g., formant enhancement effect, and improvement in ability to adjust the degree of said enhancement) as well as free control/setting of the characteristics of the filter 203 in conformity with the demands of users. It is natural that the present invention should not be construed as being limited by the expression (10) and that other processes may be employed which make the formants dull within the PARCOR domain. Further, with respect to the filter using as its filter coefficient the PARCOR or the parameter generated on the basis of the PARCOR, it is relatively easy to prove and secure its stability on the PARCOR domain, since the stability condition is given by following simple equation:

$$-1 < \phi_i < 1 \tag{11}$$

Figure 22:
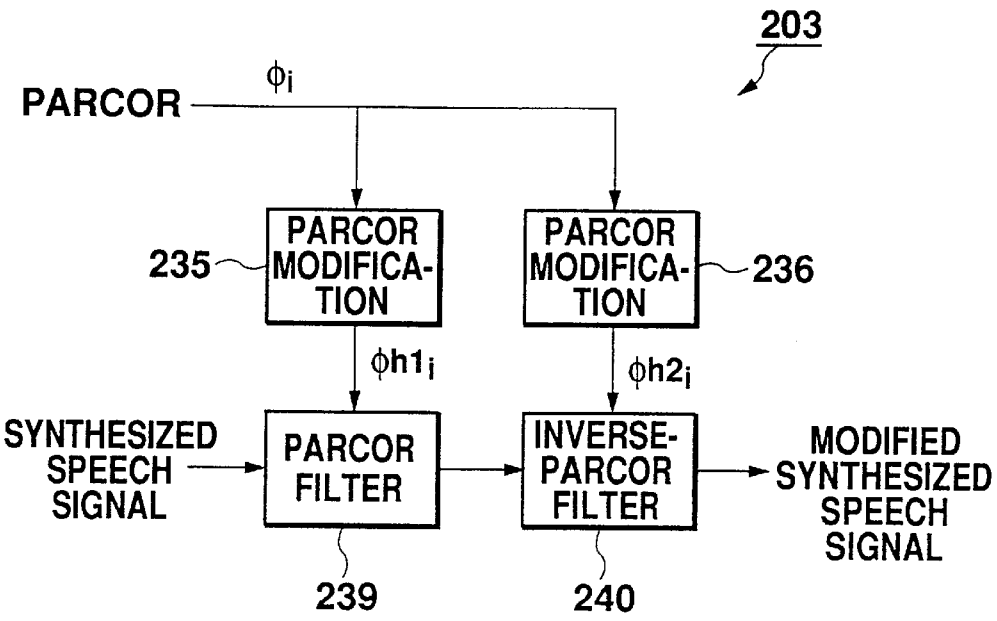
FIG. 21 and FIG. 22 are block diagrams each showing a configuration of a speech modification filter in accordance with an embodiment executing filtering within PARCOR domain among the preferred embodiments of the present invention.
Figure 21:
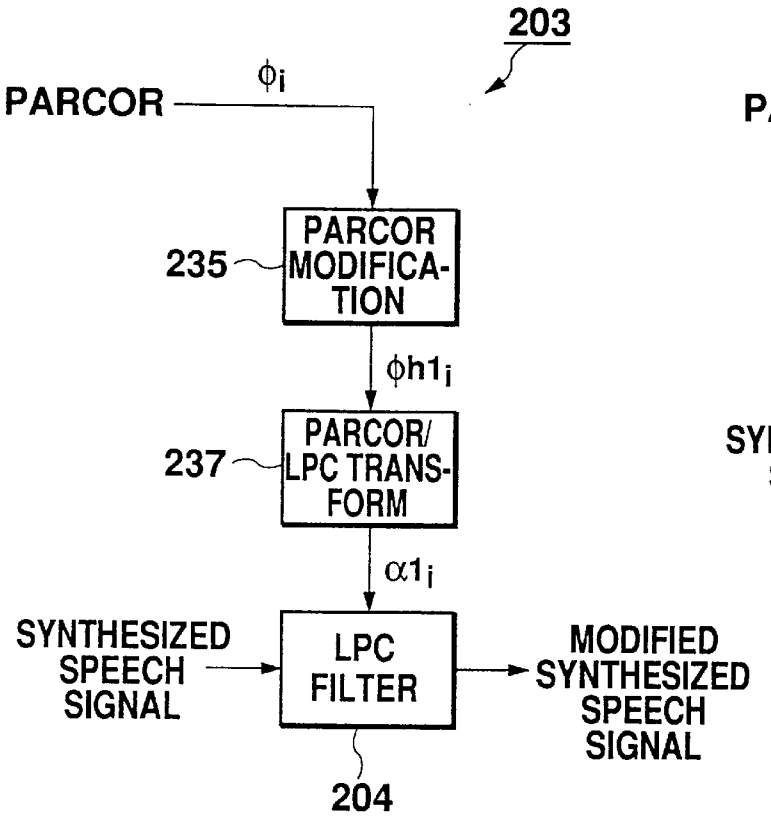
Figure 23:
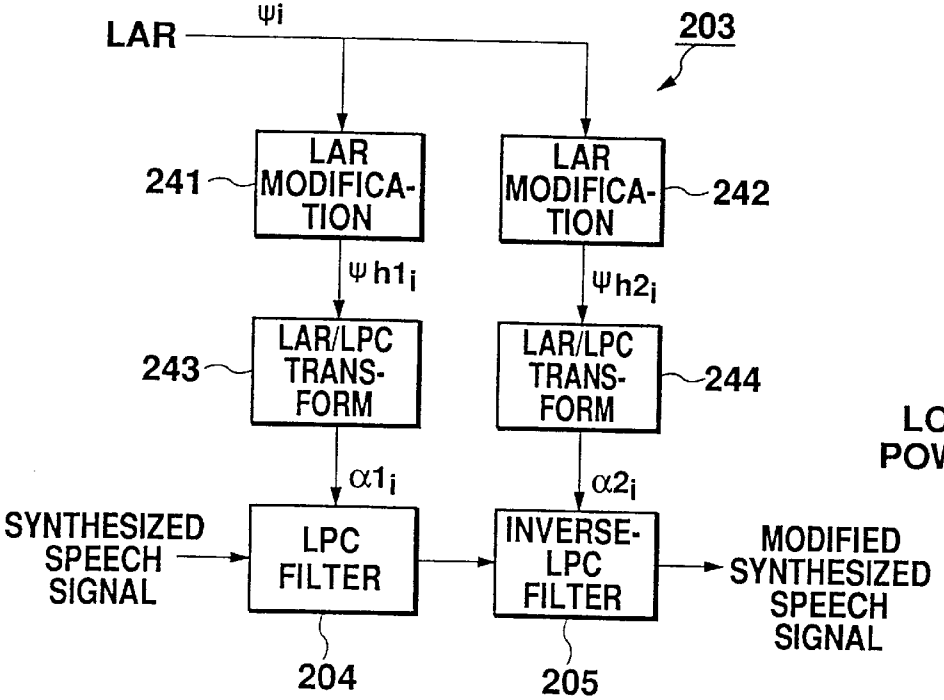
FIG. 23 is a block diagram showing a configuration of a speech modification filter in accordance with an LAR-based embodiment among the preferred embodiment of the present invention.

In other words, so long as the equation (11) is satisfied, the filter using PARCOR based filter coefficient is stable. Therefore, according to this embodiment, the degree of freedom of filter design is enhanced. For example, one can use as a PARCOR modification process the process of modifying PARCOR $\phi_i$ independently for respective i. In addition, application to the systems transmitting or storing PARCOR as spectral information would ensure a good connectability due to the fact that there is no necessity for spectrum re-analysis and parameter transform. FIG. 20 graphically represents the log-power vs. frequency spectrum characteristics of the filter 203 in FIG. 19. In the graph, A, B, C and D respectively denote the synthesizer 202 characteristics=1/A (z), filter 204 characteristics=1/A1 (z), filter 205 inverse-characteristics=1/A2 (z), and filter 203 characteristics=A2 (z)/A1 (z), with $\nu$=0.98 and $\eta$=0.9. As is apparent from the comparison between FIGS. 20 and 33, this embodiment allows the spectrum peak-valley structure to appear more or less stronger than that of the configuration shown in the reference 1. Through aural comparisons of the modified synthesized speech, the present inventor has ascertained that use of the filter 203 of this embodiment will definitely not cause any unique distorted speech or any fluctuating tone, and will ensure a good formant enhancement effect.It will be obvious to those skilled in the art from the disclosure of this specification that the details of this PARCOR-based embodiment can be constituted from the same viewpoint as the LSP-based embodiment. It will also be easily conceivable for those skilled in the art from the disclosure of this specification to exclude inverse-LPC filtering and constituent elements associated therewith as shown in FIG. 21 and to employ a configuration including a PARCOR filter 239 and an inverse-PARCOR filter 240 with modified PARCOR $\phi h1_i$ and $\phi h2_i$ used as its filter coefficients as shown in FIG. 22.

c) LAR-based EmbodimentAn embodiment entering LAR as spectral information is depicted in FIG. 23. This embodiment comprises, besides the LPC filter 204 and the inverse-LPC filter 205, LAR modification sections 241 and 242 and LAR/LPC transform sections 243 and 244. The LAR modification section 241 enters LAR $\psi_i$ as spectral information from the decoder 201 or the transform section 215 and modifies this $\psi_i$ to generate modified LAR $\psi h1_i$. In the same manner, the LAR modification section 242 also generates modified LAR $\psi h2_i$. The LAR/LPC transform section 243 transforms $\psi h1_i$ from the LAR domain into the LPC domain to generate a filter coefficient $\alpha 1_i$ for the LPC filter 204. The LAR/LPC transform section 244 transforms $\psi h2_i$ from the LAR domain into the LPC domain to generate a filter coefficient $\alpha 2_i$ for the inverse-LPC filter 205.The LAR modification sections 241 and 242 generate $\psi h1_i$ and $\psi h2_i$ respectively, using modified coefficients $\nu$ and $\eta$ satisfying for example $0 \leqq \eta \leqq \nu < 1$, and in accordance with the following expressions $$\psi h1_i = \psi_i \times \nu^i$$

$$\psi h2_i = \psi_i \times \eta^i \quad (12)$$

where i=1, 2, . . . , p

Execution of such modification enables formants to dull on the PARCOR domain.

Consequently this embodiment will ensure the same characteristic improvement effect as that of the above LPC-based embodiment and the PARCOR-based embodiment (e.g., formant enhancement effect, and improvement in ability to adjust the degree of said enhancement) as well as free control/setting of the characteristics of the filter 203 in conformity with the demands of users. It is natural that the present invention should not be construed as being limited by the expression (12) and that other processes may be employed which make the formants dull within the LAR domain. Since it is proved and secured the filter stable when the filter coefficients generated on the basis of LAR are used, the LAR modification process in this embodiment is not restricted on the aspect of the filter stability. Therefore, the degree of freedom of filter design in this embodiment is higher than those in prior arts. In addition, application to the systems transmitting or storing PARCOR as spectral information would ensure a good connectability due to the fact that there is no necessity for spectrum re-analysis and parameter transform.

Figure 24:
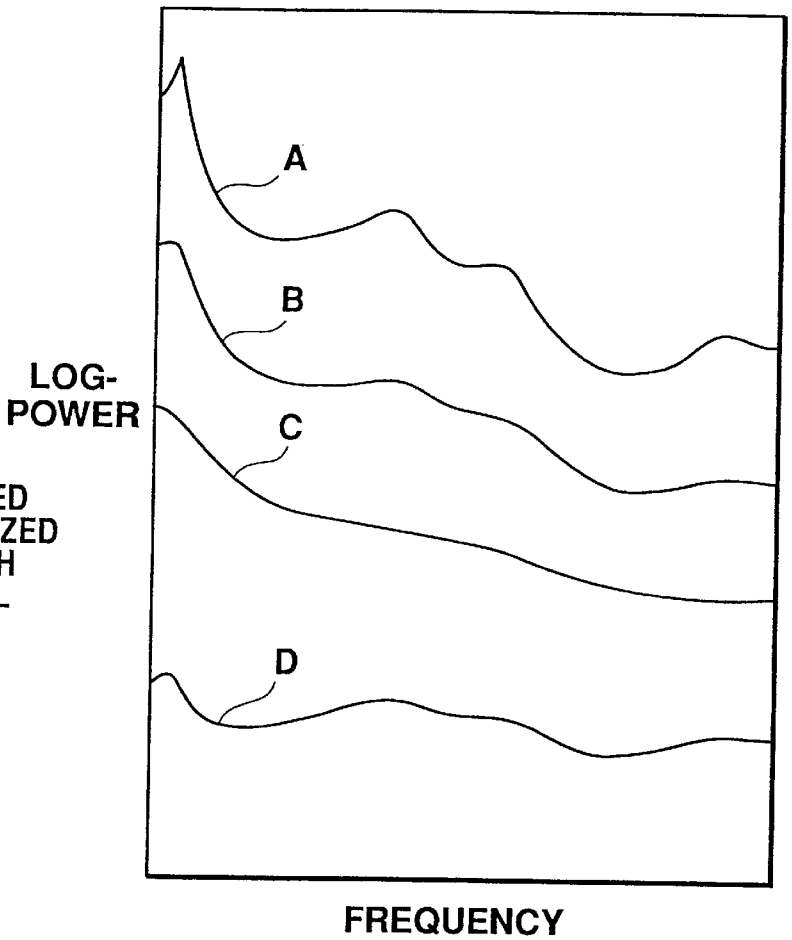
FIG. 24 is a graphical representation of log-power vs. frequency spectrum characteristics of the LAR-based embodiment among the preferred embodiments of the present invention.
Figure 34:
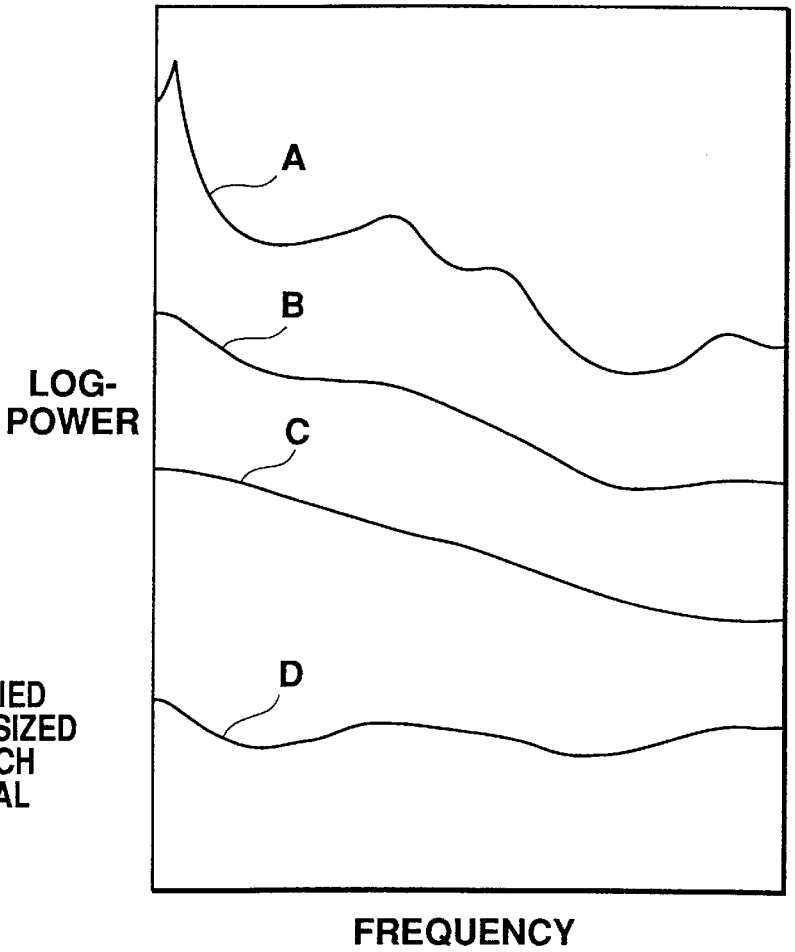
Fig. 34 PRIOR ART
Figure 31:
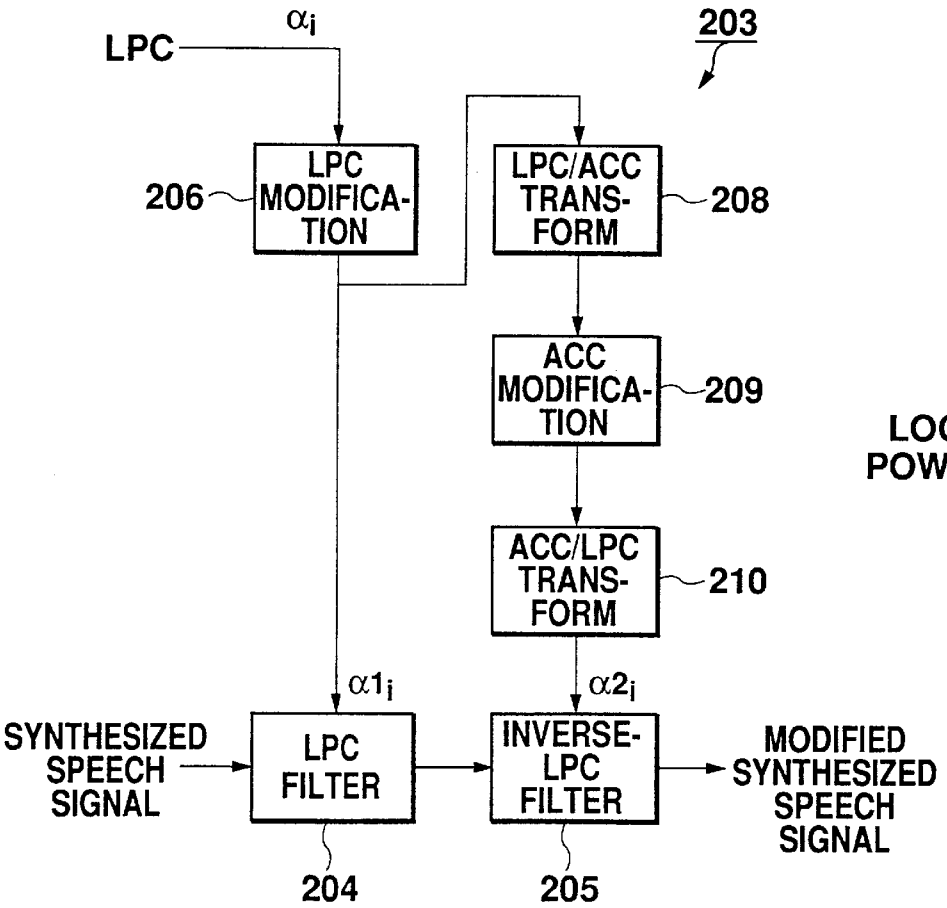
Fig. 31 PRIOR ART
Figure 35:
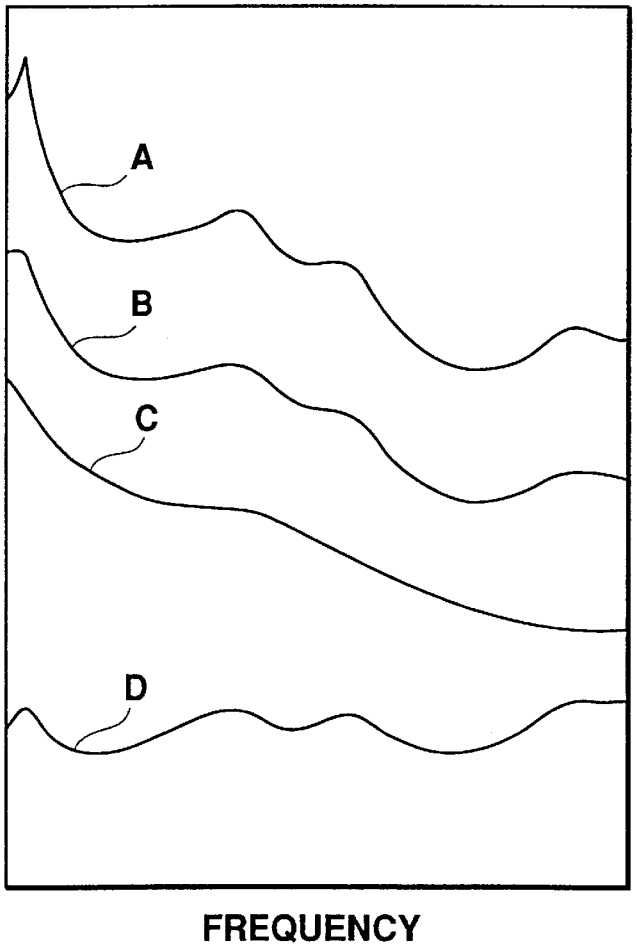
Fig. 35 PRIOR ART
Figure 32:
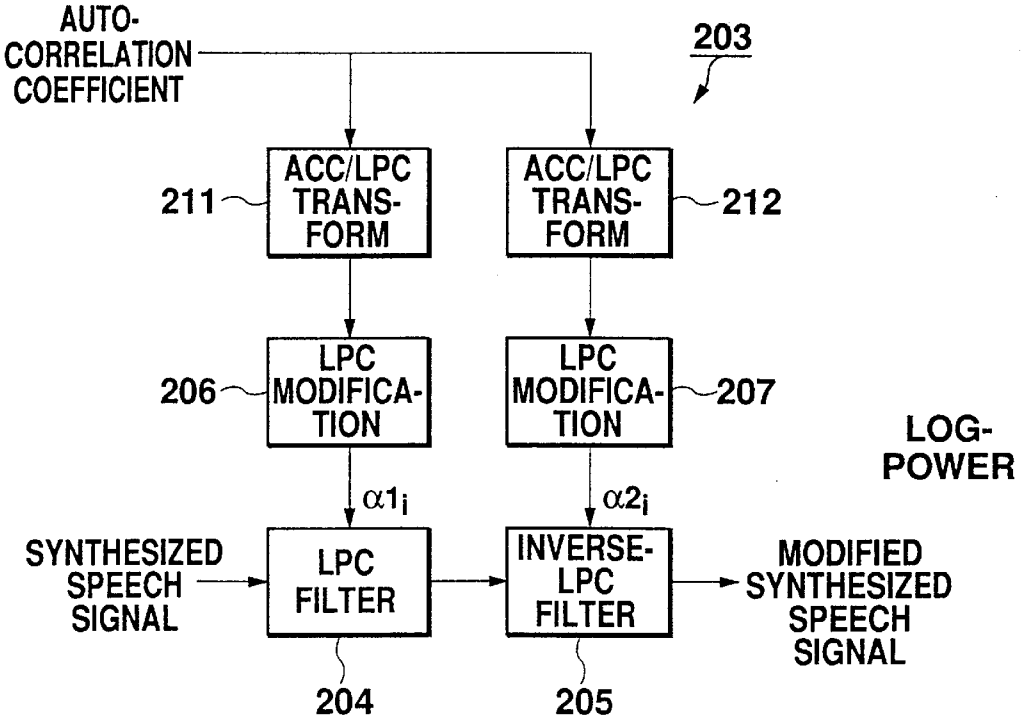
Fig. 32 PRIOR ART
Figure 36:
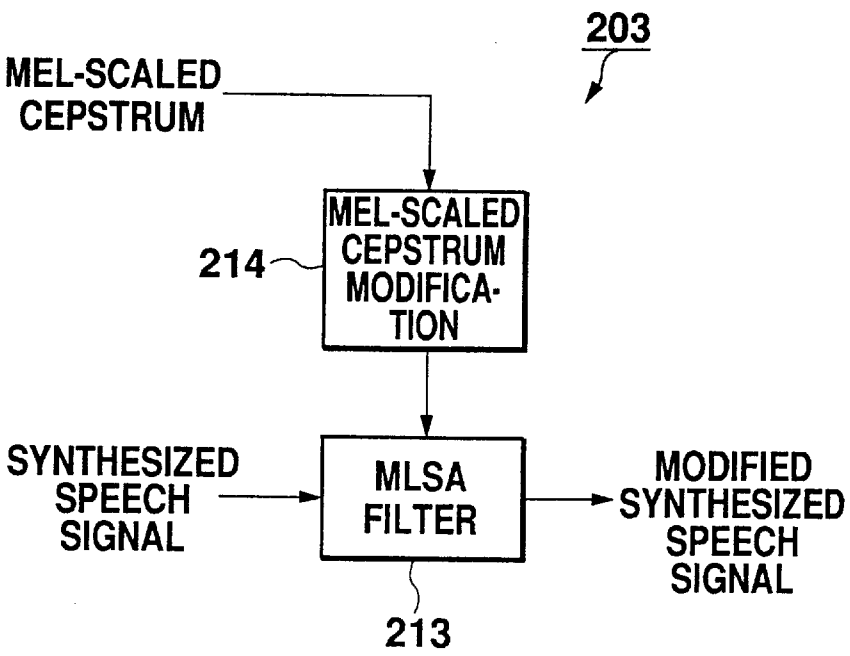
Fig. 36 PRIOR ART
FIG. 36 is a block diagram illustrating a configuration of the speech modification filter disclosed in reference 4.

FIG. 24 graphically represents the log-power vs. frequency spectrum characteristics of the filter 203 in FIG. 23. In the graph, A, B, C and D denote respectively the synthesizer 202 characteristics=1/A (z), filter 204 characteristics=1/A1 (z), filter 205 inverse-characteristics=1/A2 (z), and filter 203 characteristics=A2 (z)/A1 (z), with $\nu$=0.9 and $\eta$=0.7. The comparison between FIGS. 24 and 33 has revealed that this embodiment allows the spectrum to be flattened while leaving spectrum peak-valley structure to some extent, resulting in a better formant enhancement effect compared with the configuration disclosed in the reference 1. Also, in comparison with FIG. 34, FIG. 24 presents less distortions involved with the peak-valley structure of the spectrum. In FIG. 24 a phenomenon of integration of two formants in the middle no longer appears, which will become apparent from the comparison between the characteristics B and C of FIG. 35. Through aural comparisons of the modified synthesized speech, the present inventor has ascertained that use of the filter 203 of this embodiment will definitely not cause any unique distorted speech or any fluctuating tone, and will ensure a good formant enhancement effect.

Figure 26:
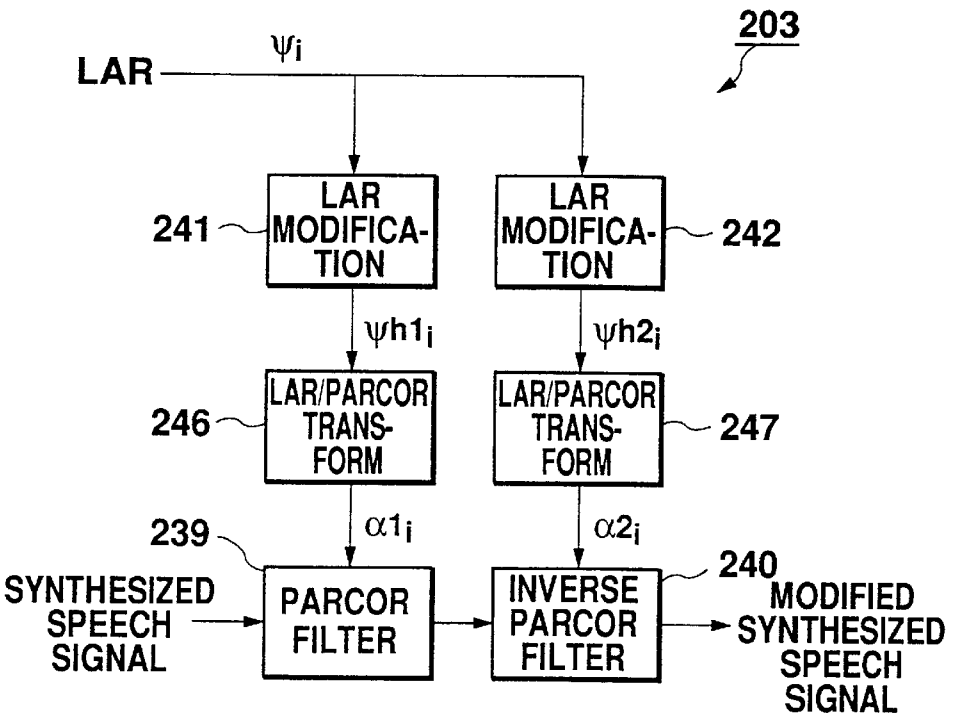
FIG. 25 and FIG. 26 are block diagrams each showing a configuration of a speech modification filter in accordance with an embodiment executing filtering within an LAR domain or a PARCOR domain among the preferred embodiments of the present invention.
Figure 25:
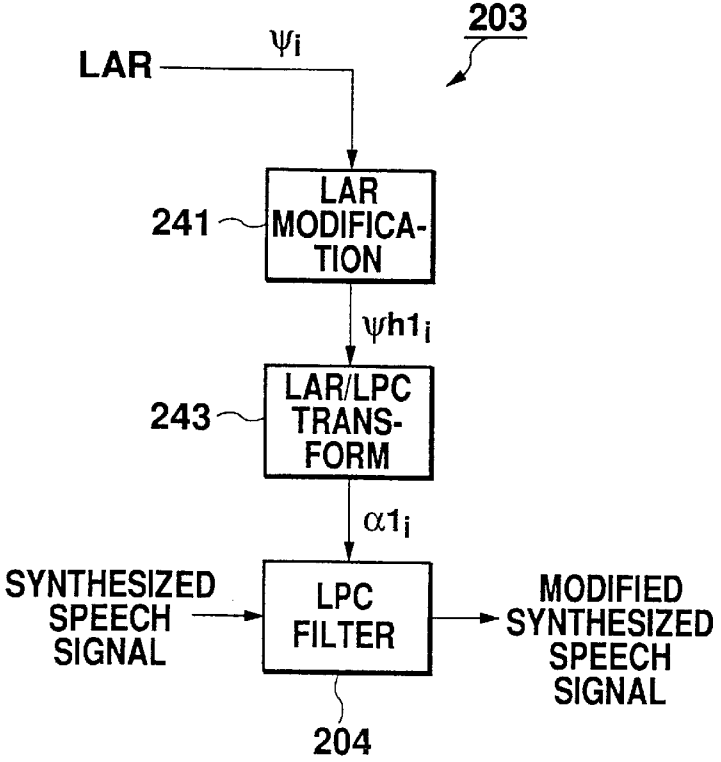

It will be obvious to those skilled in the art from the disclosure of this specification that the details of this LAR-based embodiment can be constituted from the same viewpoint as the LSP-based embodiment and the PARCOR-based embodiment. It will also be easily conceivable from the disclosure of this specification for those skilled in the art to exclude inverse-LPC filtering and constituent elements associated therewith as shown in FIG. 26 and to employ a configuration including a PARCOR-filter 239 and inverse-PARCOR filter 240 with modified LAR $\psi h1_i$ and $\psi h2_i$ used as its filter coefficients. Further, to transform the modified LAR $\psi h1_i$ and $\psi h2_i$ from LAR domain to PARCOR domain, LAR/PARCOR transforming sections 246 and 247 are provided in FIG. 26. Since in general the LAR/PARCOR transforming process is relatively simple and easy to perform than the LAR/LPC transforming, the LAR/PARCOR transforming sections 246 and 247 can be implemented with less processing steps or with smaller circuits than the LAR/LPC transforming sections 243 and 244. Therefore, according to FIG. 27 embodiment, the filter coefficients $\alpha 1_i$ and $\alpha 2_i$ are derived within shorter period than, and whole process by the filter 203 is reduced from, FIGS. 23 and 25 embodiments.

d) Supplement

Figure 27:
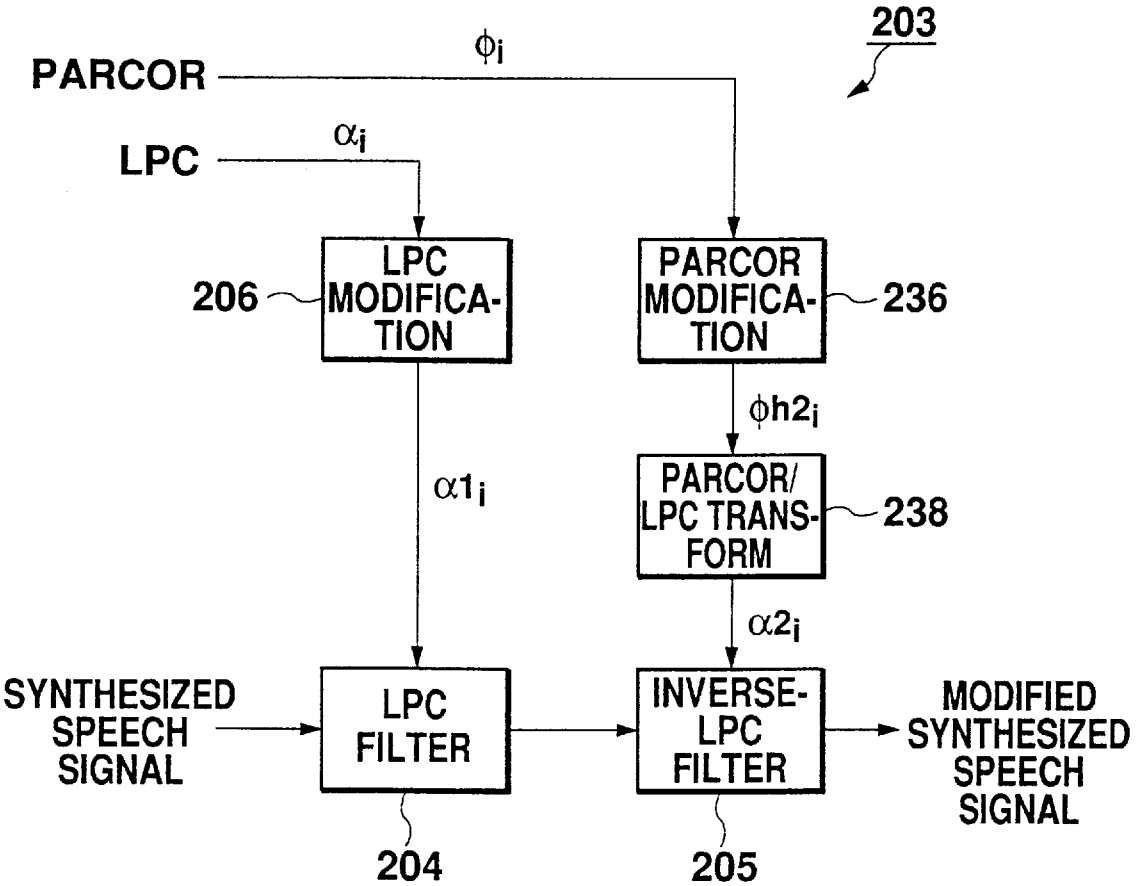
FIG. 27 is a block diagram showing a configuration of a speech modification filter in accordance with an embodiment utilizing a plurality of parameters among the preferred embodiments of the present invention.
Figure 28:
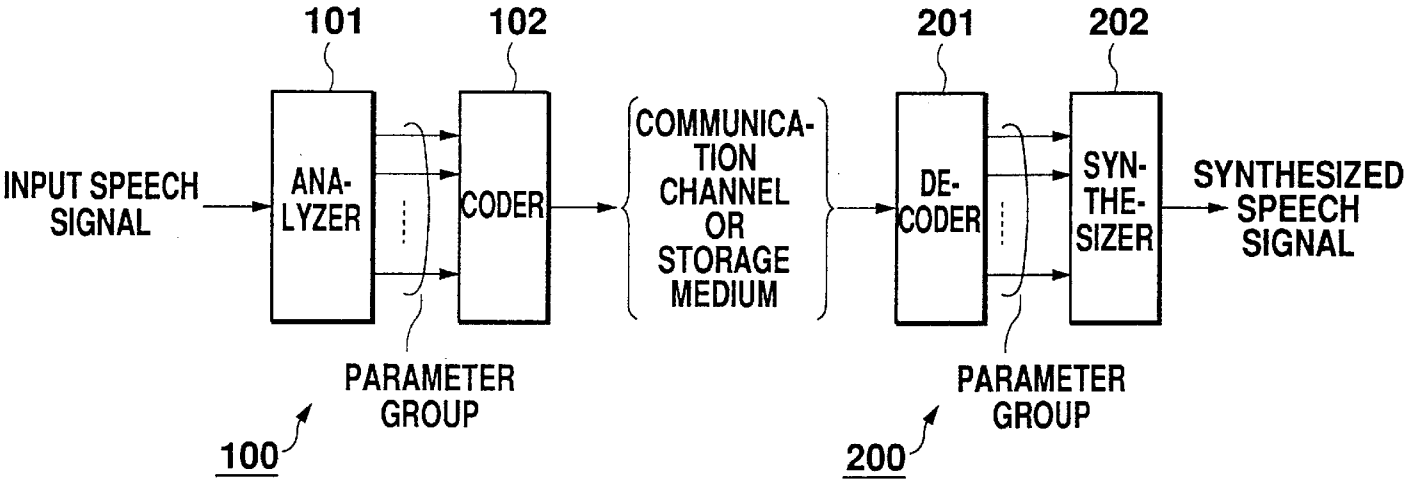
Fig. 28 PRIOR ART
FIG. 28 is a block diagram illustrating, by way of example, a configuration of a speech analysis/synthesis system.

It would be easily conceivable from the disclosure of this specification for those skilled in the art to selectively combine the above-described LSP-based embodiment, PARCOR-based embodiment, and LAR-based embodiment. It could also be easily conceived from the disclosure of this specification for those skilled in the art to combine each embodiment of the present invention with the conventional LPC-based apparatus. These various combinations contribute to the implementation of a filter 203 having a high degree of freedom of characteristic design, which could not be otherwise implemented. For example, as shown in FIG. 27, the filter coefficient $\alpha 1_i$ of the filter 204 may be defined by the same method as the reference 1 whereas the filter coefficient $\alpha 2_i$ of the filter 205 may be defined by the same method as the PARCOR-based embodiment. This configuration would lead to a filter 203 presenting a lower spectral gradient than the characteristics D of FIG. 33 and less distortions in the vicinity of formants than the characteristics D of FIG. 34.

In front of or behind the filter 203 or in parallel with the filter 203, there may be disposed another filter to perform pitch enhancement processing, high-frequency enhancement processing, formant enhancement processing, etc.

What is claimed is:

1. A filter comprising:

filtering means for filtering synthesized speech signals through a transfer function defined by filter coefficients to generate modified synthesized speech signals; and filter coefficient generation means for generating said filter coefficients on the basis of spectral information represented in the form of a multi-dimensional vector and belonging to a predetermined domain and pertaining to input speech signals, in such a manner that formant characteristics of said modified synthesized speech signals are enhanced in accordance with said spectral information and in comparison with formant characteristics of said synthesized speech signals;

said spectral information being any one of line spectrum pairs (LSP) information, partial autocorrelation coefficients (PARCOR) information and log area ratio (LAR) information.

2. A filter according to claim 1, wherein said filter coefficients belong to a linear prediction coefficients (LPC) domain.

3. A filter according to claim 2, wherein said filter coefficient generation means includes:

modification means for modifying said spectral information within said predetermined domain to generate modified spectral information; and means for transforming said modified spectral information from said predetermined domain into an LPC domain to generate said filter coefficients.

4. A filter according to claim 3, wherein said modification means includes flattening means for modifying said spectral information so as to reduce peaks of formants of said modified synthesized speech signals.

5. A filter according to claim 4, wherein said spectral information is LSP information, and wherein said flattening means includes proportional division means for proportionally dividing, in accordance with a modified coefficient, said spectral information and reference information belonging to the very same domain to which said spectral information belongs to generate said modified spectral information.

6. A filter according to claim 5, wherein said proportional division means proportionally divides said spectral information and said reference information so as to impart a fixed spectral gradient to said modified synthesized speech signals.

7. A filter according to claim 5, wherein said proportional division means proportionally divides said spectral information and said reference information so as to impart to said modified synthesized speech signals a spectrum gradient reflecting an average noise spectrum.

8. A filter according to claim 5, wherein said proportional division means proportionally divides said spectral information and said reference information so as to impart to said modified synthesized speech signal a spectrum gradient reflecting a history which said spectral information has traced so far.

9. A filter according to claim 4, wherein said spectral information is either PARCOR information or LAR information, and wherein said flattening means includes means for multiplying, for each of a plurality of dimensions constituting said spectral information, said spectral information by a modified coefficient or by the power of said modified coefficient to generate said modified spectral information.

10. A filter according to claim 9, wherein said power is dependent on said dimension.

11. A filter according to claim 3, wherein said spectral information is LSP information, and wherein said modification means includes distance expansion means for expanding distances between adjacent dimensions among a plurality of dimensions representative of said spectral information to generate said modified spectral information.

12. A filter according to claim 11, wherein said distance expansion means includes:

expansion means for expanding said distances beyond said reference distance, when said distances between adjacent dimensions are less than a reference distance;

compression means for equally compressing said distances with respect to all said adjacent dimensions, after the expansion of said distances between adjacent dimensions by said expansion means, so as to ensure that the extent of said spectral information in its entirety becomes coincident with the extent before expansion.

13. A filter according to claim 3, wherein said spectral information is LSP information, and wherein said modification means includes:

proportional division means for proportionally dividing, in accordance with a modified coefficient, said spectral information and reference information belonging to the very same domain to which said spectral information belongs;

distance expansion means for expanding distances between adjacent dimensions among a plurality of dimensions representative of said spectral information; and switching means for s electively using either said proportional division means or said distance expansion means to generate said modified spectral information.

14. A filter according to claim 3, wherein said spectral information is LSP information, and wherein said modification means includes:

proportional division means for proportionally dividing said spectral information and reference information belonging to the very same domain to which said spectral information belongs in accordance with a modified coefficient;

distance expansion means for expanding distances between adjacent dimensions among a plurality of dimensions representative of said spectral information; and cascade connection means for using both said proportional division means and said distance expansion means in cooperation to generate said modified spectral information.

15. A filter according to claim 3, wherein said modification means includes a translation table for storing said spectral information in correlation with said modified spectral information, said translation table generating said modified spectral information to be generated in response to the supply of said spectral information.

16. A filter according to claim 3, wherein said modification means includes a neural network which has acquired, by learning, an ability to transform said spectral information into said modified spectral information, said neural network generating modified spectral information to be generated in response to the supply of said spectral information.

17. A filter according to claim 3, wherein said modification means includes:

a plurality of category specific modification means each provided for each of a plurality of categories which do not overlap one another and which are obtained by classifying said predetermined domain;

said plurality of category specific means each includes:

means for modifying said spectral information within a corresponding category to generate modified spectral information; and means for transforming said modified spectral information from said predetermined domain into LPC domain to generate a filter coefficient.

18. A filter according to claim 3, wherein said modification means includes:

means for modifying, in accordance with a modified coefficient, said spectral information within said predetermined domain to generate modified spectrum information;

means for transforming said modified spectrum information from said predetermined domain into an LPC domain to generate said filter coefficients; and means for adjusting said modified coefficient in accordance with which category said spectral information belongs to among said plurality of categories, which are obtained by dividing said predetermined domain and which do not overlap one another.

19. A filter according to claim 1, wherein said filter coefficients belong to any one of an LSP domain and a PARCOR domain.

20. A filter according to claim 19, wherein said filter coefficient generation means includes:

modification means for modifying said spectral information within said predetermined domain to generate modified spectral information; and means for supplying said modified spectral information as said filter coefficients into said filtering means.21. A filter according to claim 1, wherein said filtering means includes a synthesis filter for implementing the denominator of said transfer function so as to ensure that formant characteristics of said modified synthesized speech signals are enhanced compared with those of said synthesized speech signals.22. A filter according to claim 21, wherein said filtering means further includes an inverse filter for suppressing a spectral gradient imparted to said modified synthesized speech signals by said synthesis filter.23. A speech synthesizing apparatus comprising:

means for generating synthesized speech signals on the basis of spectral information represented in the form of a multidimensional vector and belonging to a predetermined domain and pertaining to input speech signals;

means for filtering synthesized speech signals through a transfer function defined by filter coefficients to generate modified synthesized speech signals; and means for generating said filter coefficients on the basis of said spectral information in such a manner that formant characteristics of said modified synthesized speech signals are enhanced in accordance with said spectral information and in comparison with formant characteristics of said synthesized speech signals;

said spectral information being any one of line spectrum pairs (LSP) information, partial autocorrelation coefficients (PARCOR) information and log area ratio (LAR) information.24. A speech synthesizing apparatus comprising:

means for generating a synthesized speech signal on the basis of first spectral information represented in the form of a multi-dimensional vector and belonging to a predetermined domain and pertaining to input speech signals;

means for transforming said first spectral information into second spectral information belonging to a different domain from said predetermined domain;

means for filtering synthesized speech signals through a transfer function defined by filter coefficients to generate modified synthesized speech signals; and means for generating said filter coefficients on the basis of said second spectral information so as to ensure that formant characteristics of said modified synthesized speech signals are enhanced in accordance with said second spectral information and in comparison with formant characteristics of said synthesized speech signals;

said spectral information being any one of line spectrum pairs (LSP) information, partial autocorrelation coefficients (PARCOR) information and log area ratio (LAR) information.25. A speech synthesizing apparatus comprising:

means for generating synthesized speech signals on the basis of first spectral information represented in the form of a multi-dimensional vector and belonging to a predetermined domain and pertaining to input speech signals;

means for analyzing said synthesized speech signals to generate second spectral information;

means for filtering synthesized speech signals through a transfer function defined by filter coefficients to generate modified synthesized speech signals; and means for generating said filter coefficients on the basis of said second spectral information so as to ensure that formants characteristics of said modified synthesized speech signals are enhanced in accordance with said second spectral information and in comparison with formant characteristics of said synthesized speech signals;

said spectral information being any one of line spectrum pairs (LSP) information, partial autocorrelation coefficients (PARCOR) information and log area ratio (LAR) information.26. A speech storage/transmission system comprising:

means for analyzing input speech signals to generate spectral information represented in the form of a multidimensional vector and belonging to a predetermined domain and pertaining to said input speech signals;

means for storing or transmitting said spectral information; means for generating synthesized speech signals on the basis of said spectral information which has been stored or transmitted;

means for filtering said synthesized speech signals through &-transfer function defined by filter coefficients to generate modified synthesized speech signals; and means for generating said filter coefficients on the basis of said spectral information so as to ensure that formant characteristics of said modified synthesized speech signals are enhanced in accordance with said spectral information and in comparison with formant characteristics of said synthesized speech signals;

said spectral information being any one of line spectrum pairs (LSP) information, partial autocorrelation coefficients (PARCOR) information and log area ratio (LAR) information.27. A speech storage/transmission system comprising:

means for analyzing input speech signals to generate first spectral information represented in the form of a multidimensional vector and belonging to a predetermined domain and pertaining to said input speech signals;

means for storing or transmitting said first spectral information;

means for generating a synthesized speech signal on the basis of said first spectral information which has been stored or transmitted;

means for transforming said first spectral information into second spectral information belonging to a different domain from said predetermined domain;

means for filtering said synthesized speech signals through a transfer function defined by filter coefficients to generate modified synthesized speech signals; and means for generating said filter coefficients on the basis of said second spectral information so as to ensure that formant characteristics of said modified synthesized speech signals are enhanced in accordance with said second spectral information and in comparison with formant characteristics of said synthesized speech signals;

said spectral information being any one of line spectrum pairs (LSP) information, partial autocorrelation coefficients (PARCOR) information and log area ratio (LAR) information.28. A speech storage/transmission system comprising:

means for analyzing input speech signals to generate first spectral information represented in the form of a multi-dimensional vector and belonging to a predetermined domain and pertaining to said input speech signals;

means for storing or transmitting said first spectral information;

means for generating synthesized speech signals on the basis of said first spectral information which has been stored or transmitted;

means for analyzing said synthesized speech signals to generate second spectral information;

means for filtering said synthesized speech signals through a transfer function defined by filter coefficients to generate modified synthesized speech signals; and means for generating said filter coefficients on the basis of said second spectral information so as to ensure that formant characteristics of said modified synthesized speech signal are enhanced in accordance with said second spectral information and in comparison with formant characteristics of said synthesized speech signals;

said spectral information being any one of line spectrum pairs (LSP) information, partial autocorrelation coefficients (PARCOR) information and log area ratio (LAR) information.

29. A speech modification method comprising:

first step of filtering synthesized speech signals through a translation function defined by filter coefficients to generate modified synthesized speech signals; and second step of generating said filter coefficients on the basis of spectral information represented by a multi-dimensional vector and belonging to a predetermined domain and pertaining to said synthesized speech signals, so as to ensure that formant characteristics of said modified synthesized speech signals are enhanced in accordance with said spectral information and in comparison with formant characteristics of said synthesized speech signals; said second step preceding the execution of said first step;

said spectral information being any one of line spectrum pairs (LSP) information, partial autocorrelation coefficients (PARCOR) information and log area ratio (LAR) information.

* * * * *